US008466764B2

(12) United States Patent
Bogert et al.

(10) Patent No.: US 8,466,764 B2
(45) Date of Patent: Jun. 18, 2013

(54) LOW PROFILE LAYERED COIL AND CORES FOR MAGNETIC COMPONENTS

(75) Inventors: Robert James Bogert, Lake Worth, FL (US); Yipeng Yan, Shanghai (CN); Frank Anthony Doljack, Pleasanton, CA (US); Hundi Panduranga Kamath, Los Altos, CA (US)

(73) Assignee: Cooper Technologies Company, Houston, TX (US)

( * ) Notice: Subject to any disclaimer, the term of this patent is extended or adjusted under 35 U.S.C. 154(b) by 165 days.

(21) Appl. No.: 12/766,227

(22) Filed: Apr. 23, 2010

(65) Prior Publication Data

US 2010/0259351 A1 Oct. 14, 2010

Related U.S. Application Data

(63) Continuation-in-part of application No. 11/519,349, filed on Sep. 12, 2006, now Pat. No. 7,791,445, and a continuation-in-part of application No. 12/181,436, filed on Jul. 29, 2008, now Pat. No. 8,378,777.

(60) Provisional application No. 61/175,269, filed on May 4, 2009, provisional application No. 61/080,115, filed on Jul. 11, 2008.

(51) Int. Cl.
*H01F 27/02* (2006.01)

(52) U.S. Cl.
USPC ..... 336/83

(58) Field of Classification Search
USPC ..... 336/65, 83, 200, 232–234, 212
See application file for complete search history.

(56) References Cited

U.S. PATENT DOCUMENTS

| | | | |
|---|---|---|---|
| 2,391,563 | A | 12/1945 | Goldberg |
| 3,255,512 | A | 6/1966 | Lochner et al. |
| 4,072,780 | A | 2/1978 | Zillman |
| 4,313,152 | A | 1/1982 | Vranken |
| 4,322,698 | A | 3/1982 | Takahashi et al. |
| 4,498,067 | A | 2/1985 | Kumokawa et al. |
| 4,543,553 | A | 9/1985 | Mandai et al. |
| 4,689,594 | A | 8/1987 | Kawabata et al. |
| 4,750,077 | A | 6/1988 | Amagasa |
| 4,758,808 | A | 7/1988 | Sasaki et al. |
| 4,803,425 | A | 2/1989 | Swanberg |
| 4,873,757 | A | 10/1989 | Williams |

(Continued)

FOREIGN PATENT DOCUMENTS

| | | |
|---|---|---|
| DE | 8132269 | 1/1986 |
| DE | 102005039379 A1 | 3/2007 |

(Continued)

OTHER PUBLICATIONS

International Search Report and Written Opinion of PCT/US2010/032787; Jul. 14, 2010; 20 pages.

(Continued)

*Primary Examiner* — Tuyen Nguyen
(74) *Attorney, Agent, or Firm* — Armstrong Teasdale LLP

(57) ABSTRACT

A low profile magnetic component includes at least one coil layer defining a generally planar coil winding having a center area and a number of turns extending about the center area. A body encloses the coil layer, and is fabricated from one of a dielectric material and a magnetic material. A magnetic core material occupies at least the center area of the coil layer.

30 Claims, 14 Drawing Sheets

U.S. PATENT DOCUMENTS

| | | | | |
|---|---|---|---|---|
| 5,032,815 | A | 7/1991 | Kobayashi et al. | |
| 5,045,380 | A | 9/1991 | Kobayashi et al. | |
| 5,142,767 | A | 9/1992 | Adams et al. | |
| 5,197,170 | A | 3/1993 | Senda et al. | |
| 5,250,923 | A | 10/1993 | Ushiro et al. | |
| 5,257,000 | A | 10/1993 | Billings et al. | |
| 5,300,911 | A | 4/1994 | Walters | |
| 5,463,717 | A | 10/1995 | Takatori et al. | |
| 5,500,629 | A | 3/1996 | Meyer | |
| 5,515,022 | A | 5/1996 | Tashiro et al. | |
| 5,532,667 | A | 7/1996 | Haertling et al. | |
| 5,572,180 | A | 11/1996 | Huang et al. | |
| 5,574,470 | A | 11/1996 | de Vall | |
| 5,631,822 | A | 5/1997 | Silberkleit et al. | |
| 5,664,069 | A | 9/1997 | Takatori et al. | |
| 5,761,791 | A | 6/1998 | Bando | |
| 5,821,638 | A | 10/1998 | Boys et al. | |
| 5,828,940 | A | 10/1998 | Learman | |
| 5,849,355 | A | 12/1998 | McHenry | |
| 5,875,541 | A | 3/1999 | Kumeji et al. | |
| 5,896,078 | A | 4/1999 | Hayakawa et al. | |
| 5,912,609 | A | 6/1999 | Usui et al. | |
| 5,945,902 | A | 8/1999 | Lipkes et al. | |
| 6,038,134 | A | 3/2000 | Belter | |
| 6,054,914 | A | 4/2000 | Abel et al. | |
| 6,107,907 | A | 8/2000 | Leigh et al. | |
| 6,114,939 | A | 9/2000 | Wittenbreder | |
| 6,169,801 | B1 | 1/2001 | Levasseur et al. | |
| 6,198,374 | B1 | 3/2001 | Abel | |
| 6,198,375 | B1 | 3/2001 | Shafer | |
| 6,204,744 | B1 | 3/2001 | Shafer et al. | |
| 6,287,931 | B1 | 9/2001 | Chen | |
| 6,293,001 | B1 | 9/2001 | Uriu et al. | |
| 6,366,192 | B2 | 4/2002 | Person et al. | |
| 6,379,579 | B1 | 4/2002 | Harada | |
| 6,420,953 | B1 | 7/2002 | Dadafshar | |
| 6,449,829 | B1 | 9/2002 | Shafer | |
| 6,460,244 | B1 | 10/2002 | Shafer et al. | |
| 6,522,549 | B2 | 2/2003 | Kano et al. | |
| 6,566,731 | B2 | 5/2003 | Ahn et al. | |
| 6,628,531 | B2 | 9/2003 | Dadafshar | |
| 6,631,545 | B1 | 10/2003 | Uriu et al. | |
| 6,653,196 | B2 | 11/2003 | Ahn et al. | |
| 6,658,724 | B2 | 12/2003 | Nakano et al. | |
| 6,710,692 | B2 | 3/2004 | Kato et al. | |
| 6,710,694 | B2 * | 3/2004 | Matsuta et al. | 336/200 |
| 6,713,162 | B2 | 3/2004 | Takaya et al. | |
| 6,720,074 | B2 | 4/2004 | Zhang et al. | |
| 6,749,827 | B2 | 6/2004 | Smalley et al. | |
| 6,750,723 | B2 | 6/2004 | Yoshida et al. | |
| 6,791,445 | B2 | 9/2004 | Shibata et al. | |
| 6,794,052 | B2 | 9/2004 | Schultz et al. | |
| 6,797,336 | B2 | 9/2004 | Garvey et al. | |
| 6,808,642 | B2 | 10/2004 | Takaya et al. | |
| 6,817,085 | B2 | 11/2004 | Uchikoba et al. | |
| 6,835,889 | B2 | 12/2004 | Hiraoka et al. | |
| 6,859,130 | B2 | 2/2005 | Nakashima et al. | |
| 6,864,201 | B2 | 3/2005 | Schultz et al. | |
| 6,879,238 | B2 | 4/2005 | Liu et al. | |
| 6,882,261 | B2 | 4/2005 | Moro et al. | |
| 6,885,276 | B2 | 4/2005 | Iha et al. | |
| 6,888,435 | B2 * | 5/2005 | Inoue et al. | 336/83 |
| 6,897,718 | B2 | 5/2005 | Yoshida et al. | |
| 6,903,641 | B2 | 6/2005 | Kondo et al. | |
| 6,908,960 | B2 | 6/2005 | Takaya et al. | |
| 6,924,777 | B2 | 8/2005 | Reasoner | |
| 6,927,738 | B2 | 8/2005 | Senba et al. | |
| 6,936,233 | B2 | 8/2005 | Smalley et al. | |
| 6,946,944 | B2 | 9/2005 | Shafer et al. | |
| 6,949,237 | B2 | 9/2005 | Smalley et al. | |
| 6,952,355 | B2 | 10/2005 | Riggio et al. | |
| 6,971,391 | B1 | 12/2005 | Wang et al. | |
| 6,979,709 | B2 | 12/2005 | Smalley et al. | |
| 6,986,876 | B2 | 1/2006 | Smalley et al. | |
| 6,998,939 | B2 | 2/2006 | Nakayama et al. | |
| 7,008,604 | B2 | 3/2006 | Smalley et al. | |
| 7,019,391 | B2 | 3/2006 | Tran | |
| 7,034,091 | B2 | 4/2006 | Schultz et al. | |
| 7,034,645 | B2 | 4/2006 | Shafer et al. | |
| 7,041,620 | B2 | 5/2006 | Smalley et al. | |
| 7,048,999 | B2 | 5/2006 | Smalley et al. | |
| 7,069,639 | B2 | 7/2006 | Choi et al. | |
| 7,071,406 | B2 | 7/2006 | Smalley et al. | |
| 7,078,999 | B2 | 7/2006 | Uriu et al. | |
| 7,081,803 | B2 | 7/2006 | Takaya et al. | |
| 7,087,207 | B2 | 8/2006 | Smalley et al. | |
| 7,091,412 | B2 | 8/2006 | Wang et al. | |
| 7,091,575 | B2 | 8/2006 | Ahn et al. | |
| 7,105,596 | B2 | 9/2006 | Smalley et al. | |
| 7,108,841 | B2 | 9/2006 | Smalley et al. | |
| 7,127,294 | B1 | 10/2006 | Wang et al. | |
| 7,142,066 | B1 | 11/2006 | Hannah et al. | |
| 7,162,302 | B2 | 1/2007 | Wang et al. | |
| 7,187,263 | B2 | 3/2007 | Vinciarelli | |
| 7,205,069 | B2 | 4/2007 | Smalley et al. | |
| 7,213,915 | B2 | 5/2007 | Tsutsumi et al. | |
| 7,221,249 | B2 | 5/2007 | Shafer et al. | |
| 7,262,482 | B2 | 8/2007 | Ahn et al. | |
| 7,263,761 | B1 | 9/2007 | Shafer et al. | |
| 7,294,366 | B2 | 11/2007 | Renn et al. | |
| 7,319,599 | B2 | 1/2008 | Hirano et al. | |
| 7,330,369 | B2 | 2/2008 | Tran | |
| 7,339,451 | B2 | 3/2008 | Liu et al. | |
| 7,345,562 | B2 | 3/2008 | Shafer et al. | |
| 7,354,563 | B2 | 4/2008 | Smalley et al. | |
| 7,375,417 | B2 | 5/2008 | Tran | |
| 7,380,328 | B2 | 6/2008 | Ahn et al. | |
| 7,390,477 | B2 | 6/2008 | Smalley et al. | |
| 7,390,767 | B2 | 6/2008 | Smalley et al. | |
| 7,393,699 | B2 | 7/2008 | Tran | |
| 7,400,512 | B2 | 7/2008 | Hirano et al. | |
| 7,419,624 | B1 | 9/2008 | Smalley et al. | |
| 7,419,651 | B2 | 9/2008 | Smalley et al. | |
| 7,442,665 | B2 | 10/2008 | Schultz et al. | |
| 7,445,852 | B2 | 11/2008 | Maruko et al. | |
| 7,449,984 | B2 * | 11/2008 | Kawarai | 336/83 |
| 7,481,989 | B2 | 1/2009 | Smalley et al. | |
| 7,485,366 | B2 | 2/2009 | Ma et al. | |
| 7,489,537 | B2 | 2/2009 | Tran | |
| 7,525,406 | B1 | 4/2009 | Cheng | |
| 7,567,163 | B2 | 7/2009 | Dadafshar et al. | |
| 7,675,396 | B2 * | 3/2010 | Liu et al. | 336/200 |
| 7,791,445 | B2 | 9/2010 | Manoukian et al. | |
| 2001/0016977 | A1 | 8/2001 | Moro et al. | |
| 2001/0043135 | A1 | 11/2001 | Yamada et al. | |
| 2002/0009577 | A1 | 1/2002 | Takaya et al. | |
| 2002/0067234 | A1 | 6/2002 | Kung | |
| 2002/0121957 | A1 | 9/2002 | Takashima et al. | |
| 2003/0029830 | A1 | 2/2003 | Takaya et al. | |
| 2003/0184423 | A1 | 10/2003 | Holdahl et al. | |
| 2004/0017276 | A1 | 1/2004 | Chen et al. | |
| 2004/0174239 | A1 | 9/2004 | Shibata et al. | |
| 2004/0189430 | A1 | 9/2004 | Matsutani et al. | |
| 2004/0209120 | A1 | 10/2004 | Inoue et al. | |
| 2004/0210289 | A1 | 10/2004 | Wang et al. | |
| 2005/0007296 | A1 | 1/2005 | Endo et al. | |
| 2005/0012581 | A1 | 1/2005 | Ono et al. | |
| 2005/0151614 | A1 | 7/2005 | Dadafshar | |
| 2005/0174207 | A1 | 8/2005 | Young et al. | |
| 2005/0184848 | A1 | 8/2005 | Yoshida et al. | |
| 2005/0188529 | A1 | 9/2005 | Uriu et al. | |
| 2006/0001517 | A1 | 1/2006 | Cheng | |
| 2006/0038651 | A1 | 2/2006 | Mizushima et al. | |
| 2006/0049906 | A1 | 3/2006 | Liu et al. | |
| 2006/0145800 | A1 | 7/2006 | Dadafshar et al. | |
| 2006/0145804 | A1 | 7/2006 | Matsutani et al. | |
| 2006/0186975 | A1 | 8/2006 | Wang | |
| 2006/0186978 | A1 | 8/2006 | Kawarai | |
| 2006/0290460 | A1 | 12/2006 | Waffenschmidt et al. | |
| 2007/0030108 | A1 | 2/2007 | Ishimoto et al. | |
| 2007/0057755 | A1 | 3/2007 | Suzuki et al. | |
| 2007/0163110 | A1 | 7/2007 | Sutardja | |
| 2007/0175545 | A1 | 8/2007 | Urata et al. | |
| 2007/0252669 | A1 | 11/2007 | Hansen et al. | |
| 2008/0001702 | A1 | 1/2008 | Brunner | |
| 2008/0012679 | A1 | 1/2008 | Okabe et al. | |
| 2008/0061917 | A1 | 3/2008 | Manoukian et al. | |

| | | | |
|---|---|---|---|
| 2008/0110014 | A1 | 5/2008 | Shafer et al. |
| 2008/0278275 | A1 | 11/2008 | Fouquet et al. |
| 2008/0310051 | A1 | 12/2008 | Yan et al. |
| 2009/0058588 | A1 | 3/2009 | Suzuki et al. |
| 2009/0066454 | A1 | 3/2009 | Hansen |
| 2009/0096565 | A1 | 4/2009 | Lanni |
| 2009/0179723 | A1 | 7/2009 | Ikriannikov et al. |
| 2009/0302512 | A1 | 12/2009 | Gablenz et al. |
| 2010/0007451 | A1 | 1/2010 | Yan et al. |
| 2010/0007453 | A1 | 1/2010 | Yan et al. |
| 2010/0007457 | A1 | 1/2010 | Yan et al. |
| 2010/0013587 | A1 | 1/2010 | Yan et al. |
| 2010/0026443 | A1 | 2/2010 | Yan et al. |
| 2010/0039200 | A1 | 2/2010 | Yan et al. |
| 2010/0085139 | A1 | 4/2010 | Yan et al. |
| 2010/0171581 | A1 | 7/2010 | Manoukian et al. |
| 2010/0259351 | A1 | 10/2010 | Bogert et al. |
| 2010/0259352 | A1 | 10/2010 | Yan et al. |
| 2010/0277267 | A1 | 11/2010 | Bogert et al. |

FOREIGN PATENT DOCUMENTS

| | | | |
|---|---|---|---|
| EP | 0655754 | A1 | 5/1995 |
| EP | 0785557 | A1 | 7/1997 |
| EP | 1150312 | A2 | 10/2001 |
| EP | 1288975 | A2 | 3/2003 |
| EP | 1288975 | A3 | 4/2003 |
| EP | 1486991 | A1 | 12/2004 |
| EP | 1526556 | A1 | 4/2005 |
| EP | 1564761 | A1 | 8/2005 |
| EP | 1833063 | A1 | 9/2007 |
| FR | 2556493 | A1 | 6/1985 |
| GB | 2044550 | A | 10/1980 |
| JP | 60-176208 | | 9/1985 |
| JP | 6423121 | | 2/1989 |
| JP | 1266705 | | 10/1989 |
| JP | 03241711 | | 10/1991 |
| JP | 05291046 | | 5/1993 |
| JP | 06216538 | | 8/1994 |
| JP | 07272932 | | 10/1995 |
| JP | 2700713 | | 1/1998 |
| JP | 10106839 | | 4/1998 |
| JP | 2000182872 | | 6/2000 |
| JP | 3108931 | | 11/2000 |
| JP | 3160685 | | 4/2001 |
| JP | 2002043143 | | 2/2002 |
| JP | 2002280745 | | 9/2002 |
| JP | 2002313632 | | 10/2002 |
| JP | 2004200468 | | 7/2004 |
| JP | 2005129968 | | 5/2005 |
| JP | 2005-217084 | | 8/2005 |
| JP | 2007227914 | | 9/2007 |
| JP | 2008078178 | | 4/2008 |
| KR | 20010014533 | | 2/2001 |
| KR | 20020071285 | | 9/2002 |
| KR | 20030081738 | | 10/2003 |
| WO | 9205568 | | 4/1992 |
| WO | 9704469 | | 2/1997 |
| WO | 0191141 | A1 | 11/2001 |
| WO | 2005008692 | A2 | 1/2005 |
| WO | 2005020254 | A2 | 3/2005 |
| WO | 2005024862 | A1 | 3/2005 |
| WO | 2006063081 | A2 | 6/2006 |
| WO | 2008008538 | A2 | 1/2008 |
| WO | 2008152493 | A2 | 12/2008 |
| WO | 2009113775 | A2 | 9/2009 |

OTHER PUBLICATIONS

Search and Examination Report for Singapore Patent Application No. 201008632-0; Apr. 17, 2012; 18 pages.
International Search Report and Written Opinion of PCT/US2011/024714; Apr. 21, 2011; 14 pages.
International Preliminary Report on Patentability of PCT/US2009/057471; Apr. 21, 2011; 6 pages.
International Search Report and Written Opinion of PCT/US2010/032803; Aug. 23, 2010; 16 pages.
International Search Report and Written Opinion of PCT/US2010/032798; Aug. 20, 2010; 15 pages.
International Search Report and Written Opinion of PCT/US2010/031886; Aug. 18, 2010; 14 pages.
International Search Report and Written Opinion of PCT/US2010/032517; Aug. 12, 2010; 16 pages.
International Search Report and Written Opinion of PCT/US2010/032414; Aug. 11, 2010; 15 pages.
International Search Report and Written Opinion of PCT/US2010/032407; Aug. 2, 2010; 19 pages.
International Search Report and Written Opinion of PCT/US2010/032992; Jul. 28, 2010; 15 pages.
International Search Report and Written Opinion of PCT/US2010/032540; Jul. 27, 2010; 20 pages.
International Search Report and Written Opinion of PCT/US2010/033006; Jul. 15, 2010; 18 pages.
International Search Report and Written Opinion of PCT/US2009/057471; Dec. 14, 2009; 14 pages.
International Search Report and Written Opinion of PCT/US2009/051005; Sep. 23, 2009; 15 pages.
VISA—Literatur; http://130.149.194.207/visa-projekt/literatur.htm; Federal Ministry of Education and Research; Jan. 23, 2009. 11 pages.
VISA—Overview; http://130.149.194.207/visa-projekt/index.htm; Federal Ministry of Education and Research; Jan. 23, 2009. 1 page.
Kim, S. et al; Electromagnetic Shielding Properties of Soft Magnetic Powder-Polymer Composite Films for the Application to Suppress Noise in the Radio Frequency Range; www.sciencedirect.com; Journal of Magnetism and Magnetic Materials 316 (2007) 472-474.
Heinrichs, F., et al.; Elements to Achieve Automotive Power; www.powersystemsdesign.com; Oct. 2004; pp. 37-40; Power Systems Design Europe.
Yoshida, S., et al.; Permeability and Electromagnetic-Interference Characteristics for Fe-Si-Al Alloy Flakes—Polymer Composite; Journal of Applied Physics; Apr. 15, 1999; pp. 4636-4638; vol. 85, No. 8; American Institute of Physics.
Ferrite Polymer Composite (FPC) Film; http:// www.epcos.com/inf/80/ap/e0001000.htm; 1999 EPCOS; 8 pages.
Kelley, A., et al; Plastic-Iron-Powder Distributed-Air-Gap Magnetic Material; Power Electronics Specialists Conference; 1990; PESC '90 Record; 21st Annual IEEE; Jun. 11-14, 1990; pp. 25-34; San Antonio, TX.
EMI Suppression Sheets (PE Series); http://www.fdk.com.jp; 1 page.
Waffenschmidt, E.; VISA—Ferrite Polymer Compounds; http://130.149.194.207/visa-projekt/technology/ferrite_polymers.htm; Federal Ministry of Education and Research; Jan. 21, 2009. 2 pages.
Waffenschmidt, E.; VISA—The Concept; http://130.149.194.207/visa-projekt/technology/concept.htm; Federal Ministry of Education and Research; Jan. 21, 2009. 2 pages.
VISA—Technology; http://130.149.194.207/visa-projekt/technology/technology.htm; Federal Ministry of Education and Research; Jan. 21, 2009. 1 page.

* cited by examiner

LOW PROFILE LAYERED COIL AND CORES FOR MAGNETIC COMPONENTS

CROSS REFERENCE TO RELATED APPLICATIONS

This application claims the benefit of U.S. Provisional Application Ser. Nos. 61/175,269 filed May 4, 2009 and 61/080,115 filed Jul. 11, 2008, and is a continuation in part application of U.S. application Ser. Nos. 11/519,349 filed Sep. 12, 2006 now U.S. Pat. No. 7,791,445 and 12/181,436 filed Jul. 29, 2008 now U.S. Pat. No. 8,378,777, the disclosures of which are each hereby incorporated by reference in their entirety.

BACKGROUND OF THE INVENTION

This invention relates generally to manufacturing of electronic components including magnetic cores, and more specifically to manufacturing of surface mount electronic components having magnetic cores and conductive coil windings.

A variety of magnetic components, including but not limited to inductors and transformers, include at least one conductive winding disposed about a magnetic core. Such components may be used as power management devices in electrical systems, including but not limited to electronic devices. Advancements in electronic packaging have enabled a dramatic reduction in size of electronic devices. As such, modern handheld electronic devices are particularly slim, sometimes referred to as having a low profile or thickness.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE INVENTION

Figure 1:
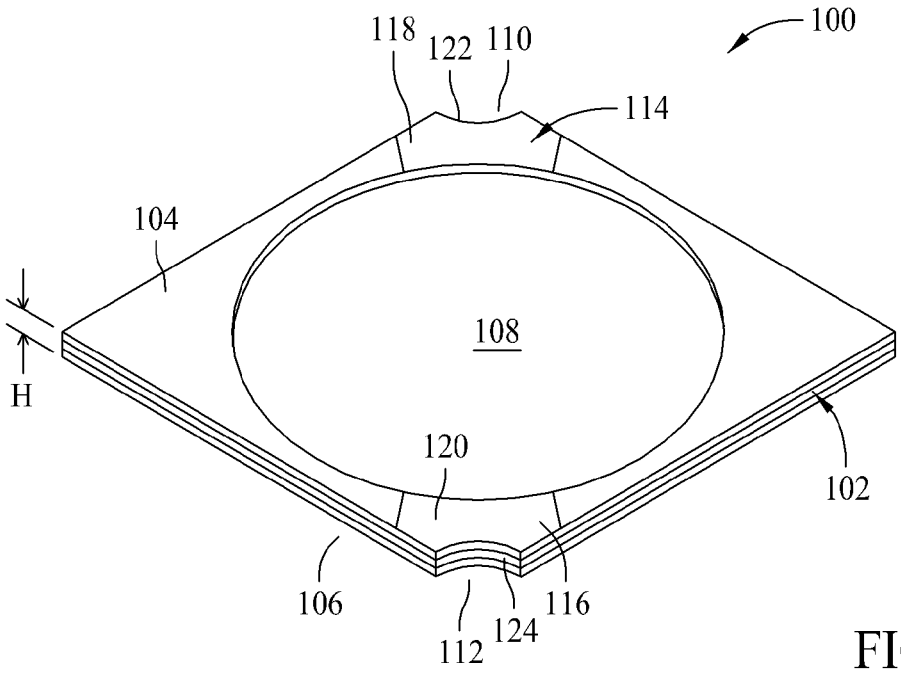
FIG. 1 is a perspective view of a magnetic component according to the present invention.

Manufacturing processes for electrical components have been scrutinized as a way to reduce costs in the highly competitive electronics manufacturing business. Reduction of manufacturing costs are particularly desirable when the components being manufactured are low cost, high volume components. In a high volume component, any reduction in manufacturing costs is, of course, significant. Manufacturing costs as used herein refers to material cost and labor costs, and reduction in manufacturing costs is beneficial to consumers and manufacturers alike. It is therefore desirable to provide a magnetic component of increased efficiency and improved manufacturability for circuit board applications without increasing the size of the components and occupying an undue amount of space on a printed circuit board.

Miniaturization of magnetic components to meet low profile spacing requirements for new products, including but not limited to hand held electronic devices such as cellular phones, personal digital assistant (PDA) devices, and other devices presents a number of challenges and difficulties. Particularly for devices having stacked circuit boards, which is now common to provide added functionality of such devices, a reduced clearance between the boards to meet the overall low profile requirements for the size of the device has imposed practical constraints that either conventional circuit board components may not satisfy at all, or that have rendered conventional techniques for manufacturing conforming devices undesirably expensive.

Such disadvantages in the art are effectively overcome by virtue of the present invention. For a full appreciation of the inventive aspects of exemplary embodiments of the invention described below, the disclosure herein will be segmented into sections, wherein Part I is an introduction to conventional magnetic components and their disadvantages; Part II discloses an exemplary embodiments of a component device according to the present invention and a method of manufacturing the same; and Part III discloses an exemplary embodiments of a modular component device according to the present invention and a method of manufacturing the same.

I. Introduction to Low Profile Magnetic Components

Conventionally, magnetic components, including but not limited to inductors and transformers, utilize a conductive winding disposed about a magnetic core. In existing components for circuit board applications, magnetic components may be fabricated with fine wire that is helically wound on a low profile magnetic core, sometimes referred to as a drum. For small cores, however, winding the wire about the drum is difficult. In an exemplary installation, a magnetic component having a low profile height of less than 0.65 mm is desired.

Challenges of applying wire coils to cores of this size tends to increase manufacturing costs of the component and a lower cost solution is desired.

Efforts have been made to fabricate low profile magnetic components, sometimes referred to as chip inductors, using deposited metallization techniques on a high temperature organic dielectric substrate (e.g. FR-4, phenolic or other material) and various etching and formation techniques for forming the coils and the cores on FR4 board, ceramic substrate materials, circuit board materials, phoenlic, and other rigid substrates. Such known techniques for manufacturing such chip inductors, however, involve intricate multi-step manufacturing processes and sophisticated controls. It would be desirable to reduce the complexity of such processes in certain manufacturing steps to accordingly reduce the requisite time and labor associated with such steps. It would further be desirable to eliminate some process steps altogether to reduce manufacturing costs.

II. Magnetic Devices Having Integrated Coil Layers

FIG. 1 is a top plan view of a first illustrative embodiment of an magnetic component or device 100 in which the benefits of the invention are demonstrated. In an exemplary embodiment the device 100 is an inductor, although it is appreciated that the benefits of the invention described below may accrue to other types of devices. While the materials and techniques described below are believed to be particularly advantageous for the manufacture of low profile inductors, it is recognized that the inductor 100 is but one type of electrical component in which the benefits of the invention may be appreciated. Thus, the description set forth below is for illustrative purposes only, and it is contemplated that benefits of the invention accrue to other sizes and types of inductors as well as other passive electronic components, including but not limited to transformers. Therefore, there is no intention to limit practice of the inventive concepts herein solely to the illustrative embodiments described herein and illustrated in the Figures.

According to an exemplary embodiment of the invention, the inductor 100 may have a layered construction, described in detail below, that includes a coil layer 102 extending between outer dielectric layers 104, 106. A magnetic core 108 extends above, below and through a center of the coil (not shown in FIG. 1) in the manner explained below. As illustrated in FIG. 1, the inductor 100 is generally rectangular in shape, and includes opposing corner cutouts 110, 112. Surface mount terminations 114, 116 are formed adjacent the corner cutouts 110, 112, and the terminations 114, 116 each include planar termination pads 118, 120 and vertical surfaces 122, 124 that are metallized, for example, with conductive plating. When the surface mounts pads 118, 120 are connected to circuit traces on a circuit board (not shown), the metallized vertical surfaces 122, 124 establish a conductive path between the termination pads 118, 120 and the coil layer 102. The surface mount terminations 114, 116 are sometimes referred to as castellated contact terminations, although other termination structures such as contact leads (i.e. wire terminations), wrap-around terminations, dipped metallization terminations, plated terminations, solder contacts and other known connection schemes may alternatively be employed in other embodiments of the invention to provide electrical connection to conductors, terminals, contact pads, or circuit terminations of a circuit board (not shown).

In an exemplary embodiment, the inductor 100 has a low profile dimension H that is less than 0.65 mm in one example, and more specifically is about 0.15 mm. The low profile dimension H corresponds to a vertical height of the inductor 100 when mounted to the circuit board, measured in a direction perpendicular to the surface of the circuit board. In the plane of the board, the inductor 100 may be approximately square having side edges about 2.5 mm in length in one embodiment. While the inductor 100 is illustrated with a rectangular shape, sometimes referred to as a chip configuration, and also while exemplary dimensions are disclosed, it is understood that other shapes and greater or lesser dimensions may alternatively utilized in alternative embodiments of the invention.

Figure 2:
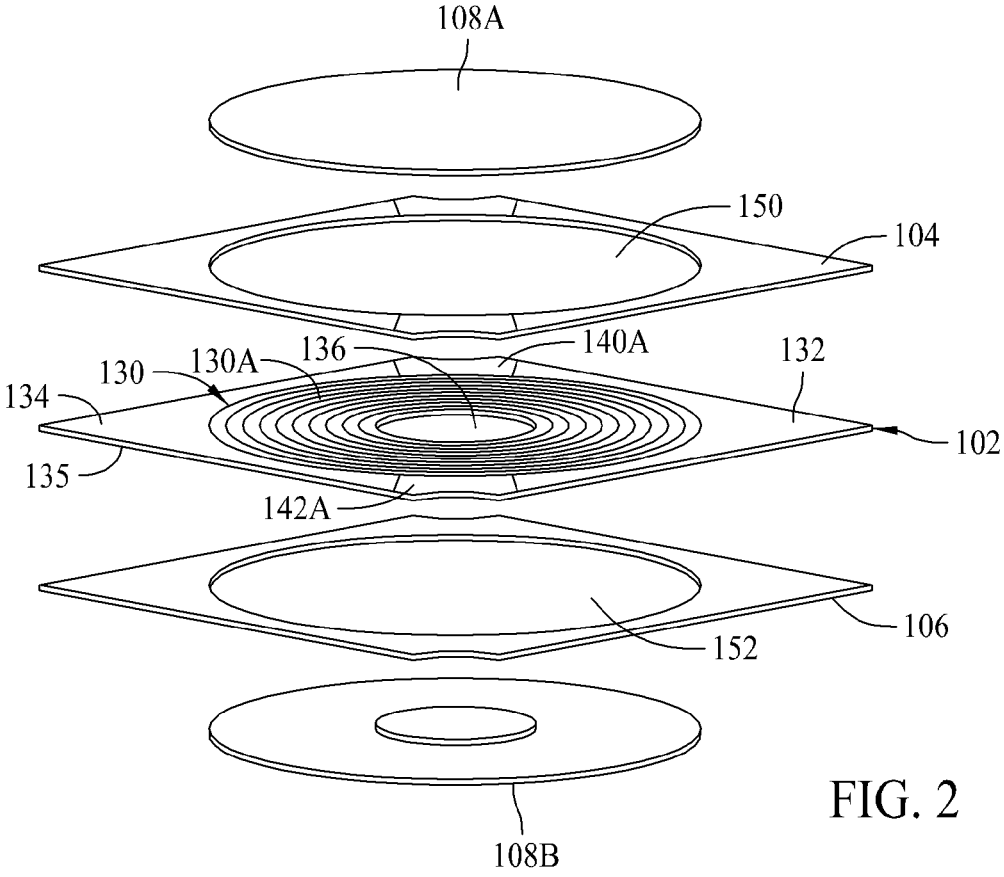
FIG. 2 is an exploded view of the device shown in FIG. 1.
Figure 3:
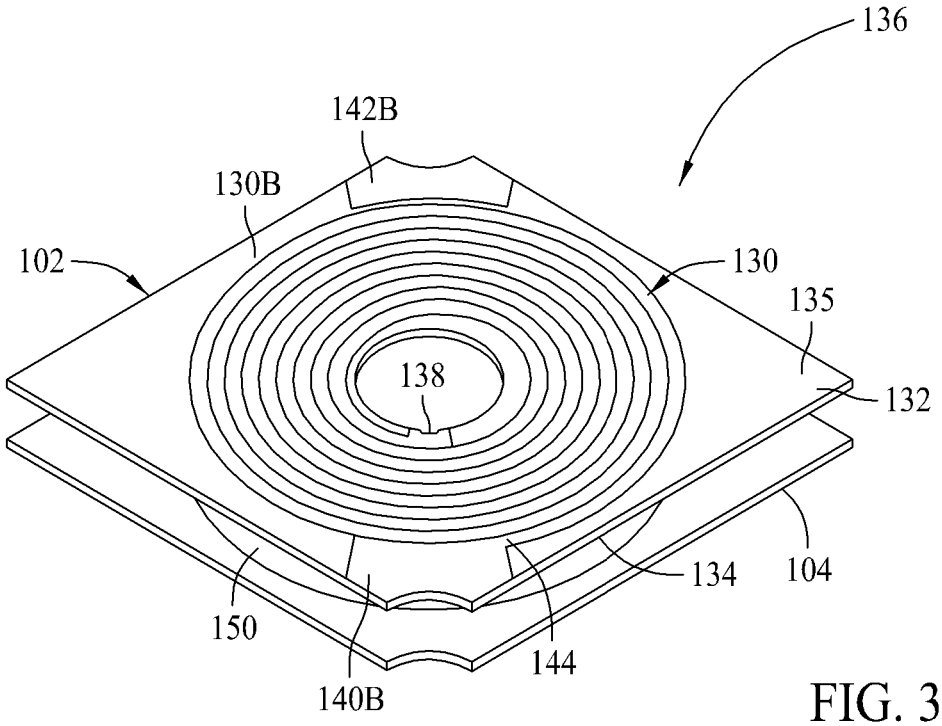
FIG. 3 is a partial exploded view of a portion of the device shown in FIG. 2.

FIG. 2 is an exploded view of the inductor 100 wherein the coil layer 102 is shown extending between the upper and lower dielectric layers 104 and 106. The coil layer 102 includes a coil winding 130 extending on a substantially planar base dielectric layer 132. The coil winding 130 includes a number of turns to achieve a desired effect, such as, for example, a desired inductance value for a selected end use application of the inductor 100. The coil winding 130 is arranged in two portions 130A and 130B on each respective opposing surface 134 (FIG. 2) and 135 (FIG. 3) of the base layer 132. That is, a double sided coil winding 130 including portions 130A and 130B extends in the coil layer 102. Each coil winding portion 130A and 130B extends in a plane on the major surfaces 134, 135 of the base layer 132.

The coil layer 102 further includes termination pads 140A and 142A on the first surface 134 of the base layer 132, and termination pads 140B and 142B on the second surface 135 of the base layer 132. An end 144 of the coil winding portion 130B is connected to the termination pad 140B on the surface 135 (FIG. 3), and an end of the coil winding portion 130A is connected to the termination pad 142A on the surface 134 (FIG. 2). The coil winding portions 130A and 130B may be interconnected in series by a conductive via 138 (FIG. 3) at the periphery of the opening 136 in the base layer 132. Thus, when the terminations 114 and 116 are coupled to energized circuitry, a conductive path is established through the coil winding portions 130A and 130B between the terminations 114 and 116.

The base layer 132 may be generally rectangular in shape and may be formed with a central core opening 136 extending between the opposing surfaces 134 and 135 of the base layer 132. The core openings 136 may be formed in a generally circular shape as illustrated, although it is understood that the opening need not be circular in other embodiments. The core opening 136 receives a magnetic material described below to form a magnetic core structure for the coil winding portions 130A and 130B.

The coil portions 130A and 130B extends around the perimeter of the core opening 136 and with each successive turn of the coil winding 130 in each coil winding portion 130A and 130B, the conductive path established in the coil layer 102 extends at an increasing radius from the center of the opening 136. In an exemplary embodiment, the coil winding 130 extends on the base layer 132 for a number of turns in a winding conductive path atop the base layer 132 on the surface 134 in the coil winding portion 130A, and also extends for a number of turns below the base layer 132 on the surface 135 in the coil winding portion 130B. The coil winding 130 may extend on each of the opposing major surfaces 134 and 135 of the base layer 132 for a specified number of turns, such as ten turns on each side of the base layer 132 (resulting in twenty total turns for the series connected coil portions 130A and 130B). In an illustrative embodiment, a twenty turn coil winding 130 produces an inductance value of about 4 to 5 μH, rendering the inductor 100 well suited as a power inductor for low power applications. The coil winding 130 may alternatively be fabricated with any number of turns to customize the coil for a particular application or end use.

As those in the art will appreciate, an inductance value of the inductor 100 depends primarily upon a number of turns of wire in the coil winding 130, the material used to fabricate the coil winding 130, and the manner in which the coil turns are distributed on the base layer 132 (i.e., the cross sectional area of the turns in the coil winding portions 130A and 130B). As such, inductance ratings of the inductor 100 may be varied considerably for different applications by varying the number of coil turns, the arrangement of the turns, and the cross sectional area of the coil turns. Thus, while ten turns in the coil winding portions 130A and 130B are illustrated, more or less turns may be utilized to produce inductors having inductance values of greater or less than 4 to 5 μH as desired. Additionally, while a double sided coil is illustrated, it is understood that a single sided coil that extends on only one of the base layer surfaces 134 or 135 may likewise be utilized in an alternative embodiment.

The coil winding 130 may be, for example, an electroformed metal foil which is fabricated and formed independently from the upper and lower dielectric layers 104 and 106. Specifically, in an illustrative embodiment, the coil portions 130A and 130B extending on each of the major surfaces 134, 135 of the base layer 132 may be fabricated according to a known additive process, such as an electro-forming process wherein the desired shape and number of turns of the coil winding 130 is plated up, and a negative image is cast on a photo-resist coated base layer 132. A thin layer of metal, such as copper, nickel, zinc, tin, aluminum, silver, alloys thereof (e.g., copper/tin, silver/tin, and copper/silver alloys) may be subsequently plated onto the negative image cast on the base layer 132 to simultaneously form both coil portions 130A and 130B. Various metallic materials, conductive compositions, and alloys may be used to form the coil winding 130 in various embodiments of the invention.

Separate and independent formation of the coil winding 130 from the dielectric layers 104 and 106 is advantageous in comparison to known constructions of chip inductors, for example, that utilize metal deposition techniques on inorganic substrates and subsequently remove or subtract the deposited metal via etching processes and the like to form a coil structure. For example, separate and independent formation of the coil winding 130 permits greater accuracy in the control and position of the coil winding 130 with respect to the dielectric layers 104, 106 when the inductor 100 is constructed. In comparison to etching processes of known such devices, independent formation of the coil winding 130 also permits greater control over the shape of the conductive path of the coil. While etching tends to produce oblique or sloped side edges of the conductive path once formed, substantially perpendicular side edges are possible with electroforming processes, therefore providing a more repeatable performance in the operating characteristics of the inductor 100. Still further, multiple metals or metal alloys may be used in the separate and independent formation process, also to vary performance characteristics of the device.

While electroforming of the coil winding 130 in a manner separate and distinct from the dielectric layers 104 and 106 is believed to be advantageous, it is understood that the coil winding 130 may be alternatively formed by other methods while still obtaining some of the advantages of the present invention. For example, the coil winding 130 may be an electro deposited metal foil applied to the base layer 132 according to known techniques. Other additive techniques such as screen printing and deposition techniques may also be utilized, and subtractive techniques such as chemical etching, plasma etching, laser trimming and the like as known in the art may be utilized to shape the coils.

The upper and lower dielectric layers 104, 106 overlie and underlie, respectively, the coil layer 102. That is, the coil layer 102 extends between and is intimate contact with the upper and lower dielectric layers 104, 106. In an exemplary embodiment, the upper and lower dielectric layers 104 and 106 sandwich the coil layer 102, and each of the upper and lower dielectric layers 104 and 106 include a central core opening 150, 152 formed therethrough. The core openings 150, 152 may be formed in generally circular shapes as illustrated, although it is understood that the openings need not be circular in other embodiments.

The openings 150, 152 in the respective first and second dielectric layers 104 and 106 expose the coil portions 130A and 130B and respectively define a receptacle above and below the double side coil layer 102 where the coil portions 130A and 130B extend for the introduction of a magnetic material to form the magnetic core 108. That is, the openings 150, 152 provide a confined location for portions 108A and 108B of the magnetic core.

Figure 4:
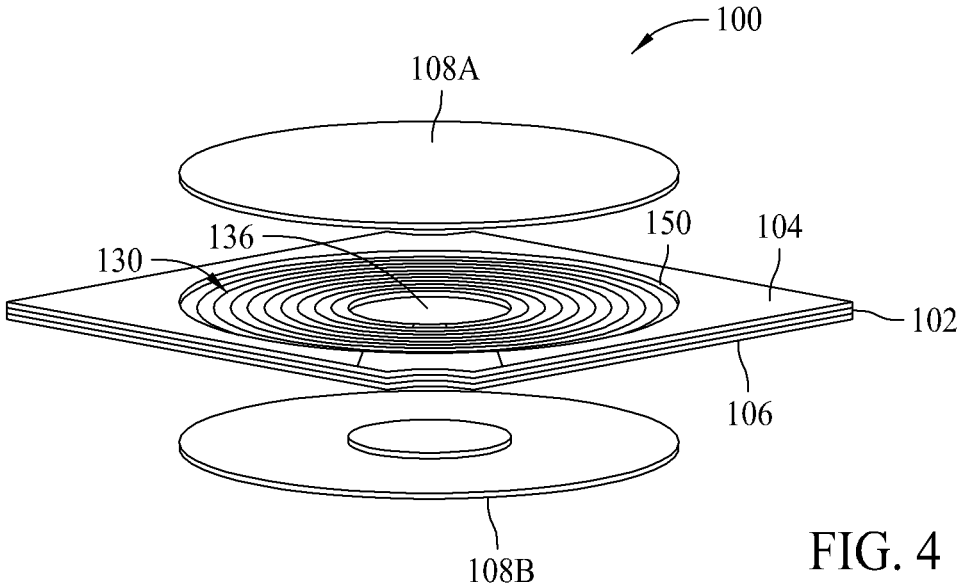
FIG. 4 is another exploded view of a the device shown in FIG. 1 in a partly assembled condition.

FIG. 4 illustrates the coil layer 102 and the dielectric layers 104 and 106 in a stacked relation. The layers 102, 104, 106 may be secured to one another in a known manner, such as with a lamination process. As shown in FIG. 4, the coil winding 130 is exposed within the core openings 150 and 152 (FIG. 2), and the core pieces 108A and 108B may be applied to the openings 150, 152 and the opening 136 in the coil layer 102.

In an exemplary embodiment, the core portions 108A and 108B are applied as a powder or slurry material to fill the openings 150 and 152 in the upper and lower dielectric layers 104 and 106, and also the core opening 136 (FIGS. 2 and 3) in the coil layer 102. When the core openings 136, 150 and 152 are filled, the magnetic material surrounds or encases the coil portions 130A and 130B. When cured, core portions 108A and 108B form a monolithic core piece and the coil portions 130A and 130B are embedded in the core 108, and the core pieces 108A and 108B are flush mounted with the upper and lower dielectric layers 104 and 106. That is, the core pieces 108A and 108B have a combined height extending through the openings that is approximately the sum of the thicknesses of the layers 104, 106 and 132. In other words, the core pieces 108A and 108B also satisfy the low profile dimension H (FIG. 1). The core 108 may be fabricated from a known magnetic permeable material, such as a ferrite or iron powder in one embodiment, although other materials having magnetic permeability may likewise be employed.

In an illustrative embodiment, the first and second dielectric layers 104 and 106, and the base layer 132 of the coil layer 102 are each fabricated from polymer based dielectric films. The upper and lower insulating layers 104 and 106 may include an adhesive film to secure the layers to one another and to the coil layer 102. Polymer based dielectric films are advantageous for their heat flow characteristics in the layered construction. Heat flow within the inductor 100 is proportional to the thermal conductivity of the materials used, and heat flow may result in power losses in the inductor 100. Thermal conductivity of some exemplary known materials are set forth in the following Table, and it may be seen that by reducing the conductivity of the insulating layers employed, heat flow within the inductor 100 may be considerably reduced. Of particular note is the significantly lower thermal conductivity of polyimide, which may be employed in illustrative embodiments of the invention as insulating material in the layers 104, 106 and 132.

| Substrate Thermal Conductivity's (W/mK) | |
|---|---|
| Alumina ($Al_2O_3$) | 19 |
| Forsterite ($2MgO—SiO_2$) | 7 |
| Cordierite ($2MgO—2Al_2O_3—5SiO_2$) | 1.3 |
| Steatite ($2MgO—SiO_2$) | 3 |
| Polyimide | 0.12 |
| FR-4 Epoxy Resin/Fiberglass Laminate | 0.293 |

One such polyimide film that is suitable for the layers 104, 106 and 132 is commercially available and sold under the trademark KAPTON® from E. I. du Pont de Nemours and Company of Wilmington, Del. It is appreciated, however, that in alternative embodiments, other suitable electrical insulation materials (polyimide and non-polyimide) such as CIRLEX® adhesiveless polyimide lamination materials, UPILEX® polyimide materials commercially available from Ube Industries, Pyrolux, polyethylene naphthalendicarboxylate (sometimes referred to as PEN), Zyvrex liquid crystal polymer material commercially available from Rogers Corporation, and the like may be employed in lieu of KAPTON®. It is also recognized that adhesiveless materials may be employed in the first and second dielectric layers 104 and 106. Pre-metallized polyimide films and polymer-based films are also available that include, for example, copper foils and films and the like, that may be shaped to form specific circuitry, such as the winding portions and the termination pads, for example, of the coil layers, via a known etching process, for example.

Polymer based films also provide for manufacturing advantages in that they are available in very small thicknesses, on the order of microns, and by stacking the layers a very low profile inductor 100 may result. The layers 104, 106 and 132 may be adhesively laminated together in a straightforward manner, and adhesiveless lamination techniques may alternatively be employed.

Figure 5:
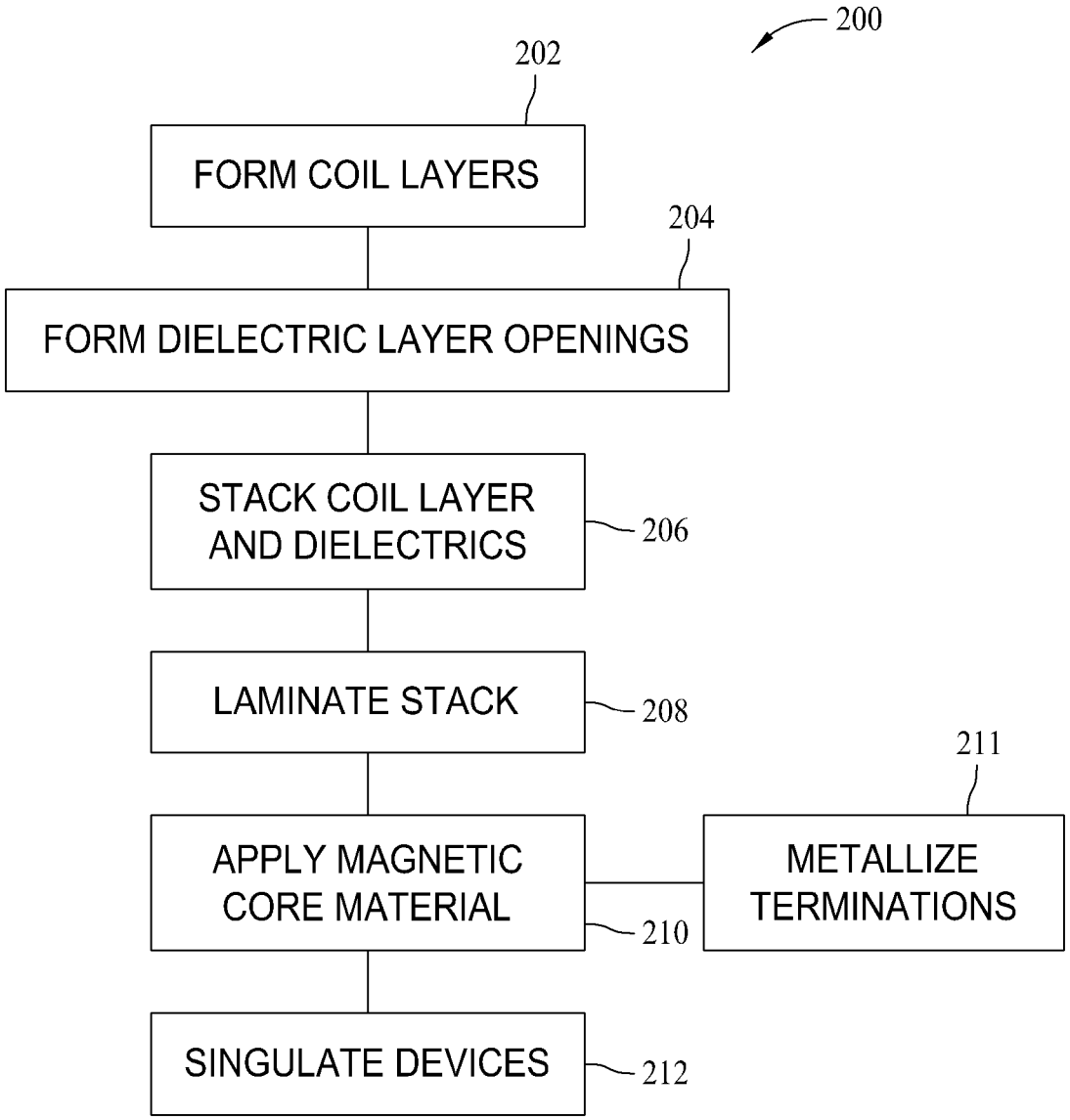
FIG. 5 is a method flowchart of a method of manufacturing the component shown in FIGS. 1-4.

The construction of the inductor also lends itself to subassemblies that may be separately provided and assembled to one another according the following method 200 illustrated in FIG. 5.

The coil windings 130 may be formed 202 in bulk on a larger piece or sheet of a dielectric base layer 132 to form 202 the coil layers 102 on a larger sheet of dielectric material. The windings 130 may be formed in any manner described above, or via other techniques known in the art. The core openings 136 may be formed in the coil layers 102 before or after forming of the coil windings 130. The coil windings 130 may be double sided or single sided as desired, and may be formed with additive electro-formation techniques or subtractive techniques for defining a metallized surface. The coil winding portions 130A and 130B, together with the termination pads 140, 142 and any interconnections 138 (FIG. 3) are provided on the base layer 132 to form 202 the coil layers 102 in an exemplary embodiment.

The dielectric layers 104 and 106 may likewise be formed 204 from larger pieces or sheets of dielectric material, respectively. The core openings 150, 152 in the dielectric layers may be formed in any known manner, including but not limited to punching techniques, and in an exemplary embodiment, the core openings 150, 152 are formed prior to assembly of the layers 104 and 106 on the coil layer.

The sheets including the coil layers 102 from step 202 and the sheets including the dielectric layers 104, 106 formed in step 204 may then be stacked 206 and laminated 208 to form an assembly as shown in FIG. 4. After stacking 206 and/or laminating 208 the sheets forming the respective coil layers 102 and dielectric layers 104 and 106, the magnetic core material may be applied 210 in the pre-formed core openings 136, 150 and 152 in the respective layers to form the cores. After curing the magnetic material, the layered sheets may be cut, diced, or otherwise singulated 212 into individual magnetic components 100. Vertical surfaces 122, 124 of the terminations 114, 116 (FIG. 1) may be metallized 211 via, for example, a plating process, to interconnect the termination pads 140, 142 of the coil layers 102 (FIGS. 2 and 3) to the termination pads 118, 120 (FIG. 1) of the dielectric layer 104.

With the above-described layered construction and methodology, magnetic components such as inductors may be provided quickly and efficiently, while still retaining a high degree of control and reliability over the finished product. By pre-forming the coil layers and the dielectric layers, greater accuracy in the formation of the coils and quicker assembly results in comparison to known methods of manufacture. By forming the core over the coils in the core openings once the layers are assembled, separately provided core structures, and manufacturing time and expense, is avoided. By embedding the coils into the core, separately applying a winding to the surface of the core in conventional component constructions is also avoided. Low profile inductor components may therefore be manufactured at lower cost and with less difficulty than known methods for manufacturing magnetic devices.

It is contemplated that greater or fewer layers may be fabricated and assembled into the component 100 without departing from the basic methodology described above. Using the above described methodology, magnetic components for inductors and the like may be efficiently formed using low cost, widely available materials in a batch process using relatively inexpensive techniques and processes. Additionally, the methodology provides greater process control in fewer manufacturing steps than conventional component constructions. As such, higher manufacturing yields may be obtained at a lower cost.

III. A Modular Approach

Figure 6:
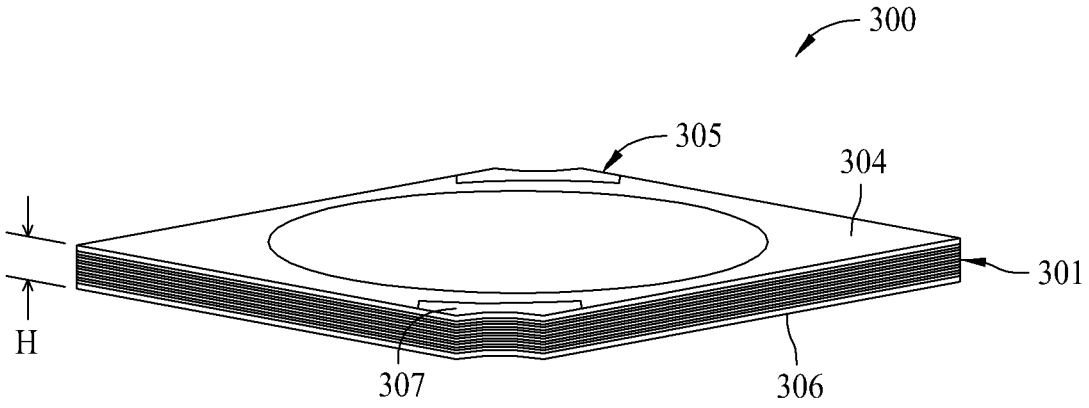
FIG. 6 is a perspective view of another embodiment of a magnetic component according to the present invention.
Figure 7:
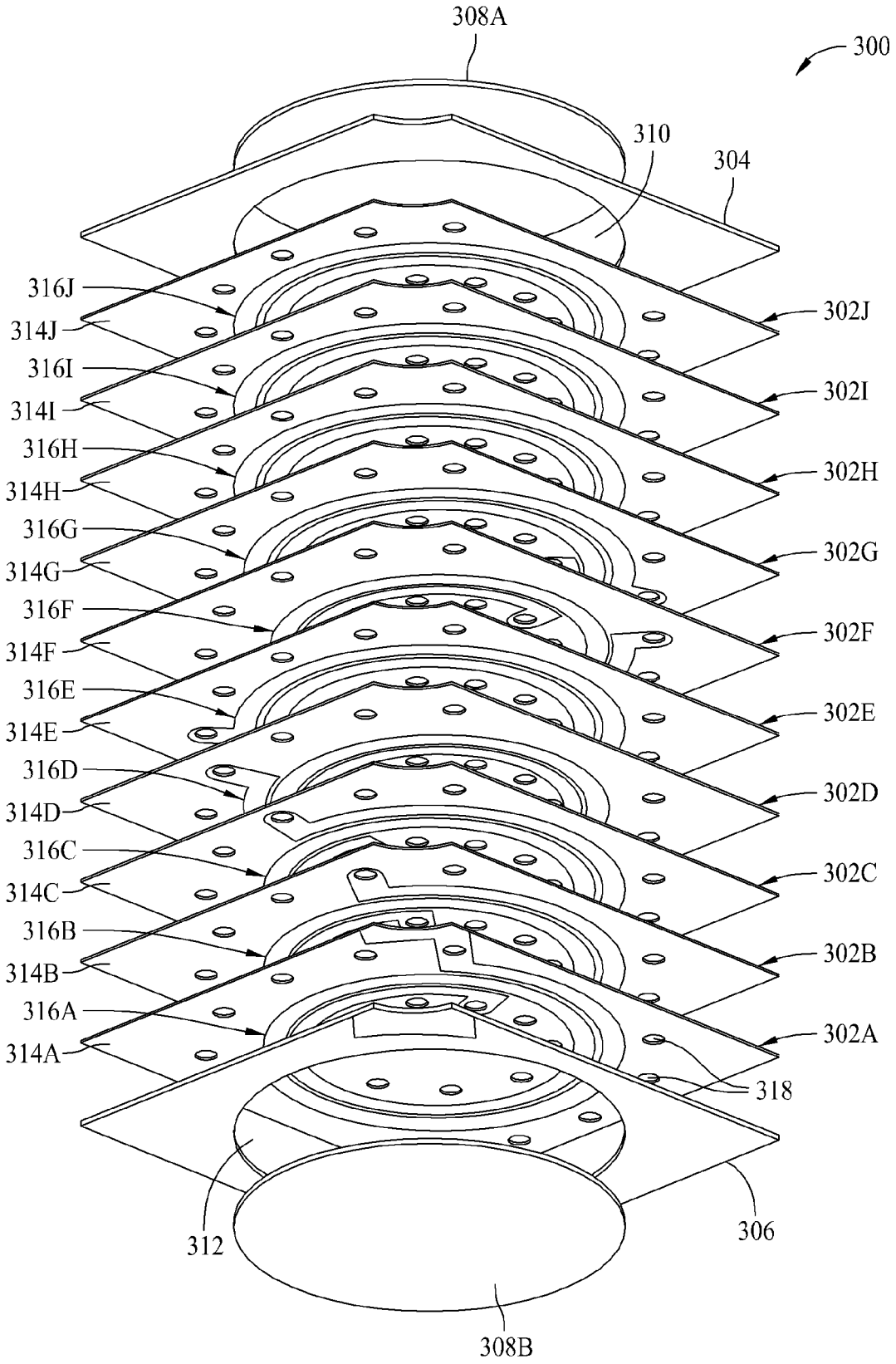
FIG. 7 is an exploded view of the magnetic component shown in FIG. 6.

FIGS. 6 and 7 illustrate another embodiment of a magnetic component 300 including a plurality of substantially similar coil layers stacked upon one another to form a coil module 301 extending between upper and lower dielectric layers 304 and 306. More specifically, the coil module 301 may include coil layers 302A, 302B, 302C, 302D, 302E, 302F, 302G, 302H, 302I and 302J connected in series with one another to define a continuous current path through the coil layers 302 between surface mount terminations 305, 307, which may include any of the termination connecting structures described above.

Like the component 100 described above, the upper and lower dielectric layers 304 and 306 include pre-formed openings 310, 312 defining receptacles for magnetic core portions 308A and 308B in a similar manner as that described above for the component 100.

Each of the coil layers 302A, 302B, 302C, 302D, 302E, 302F, 302G, 302H, 302I and 302J includes a respective dielectric base layer 314A, 314B, 314C, 314D, 314E, 314F, 314G, 314H, 314I and 314J and a generally planar coil winding portion 316A, 316B, 316C, 316D, 316E, 316F, 316G, 316H, 316I and 316J. Each of the coil winding portions 316A, 316B, 316C, 316D, 316E, 316F, 316G, 316H, 316I and 316J includes a number of turns, such as two in the illustrated embodiment, although greater and lesser numbers of turns may be utilized in another embodiment. Each of the coil winding portions 316 may be single-sided in one embodiment. That is, unlike the coil layer 102 described above, the coil layers 302 may include coil winding portions 316 extending on only one of the major surfaces of the base layers 314, and the coil winding portions 316 in adjacent coil layers 302 may be electrically isolated from one another by the dielectric base layers 314. In another embodiment, double sided coil windings may be utilized, provided that the coil portions are properly isolated from one another when stacked to avoid electrical shorting issues.

Figure 8:
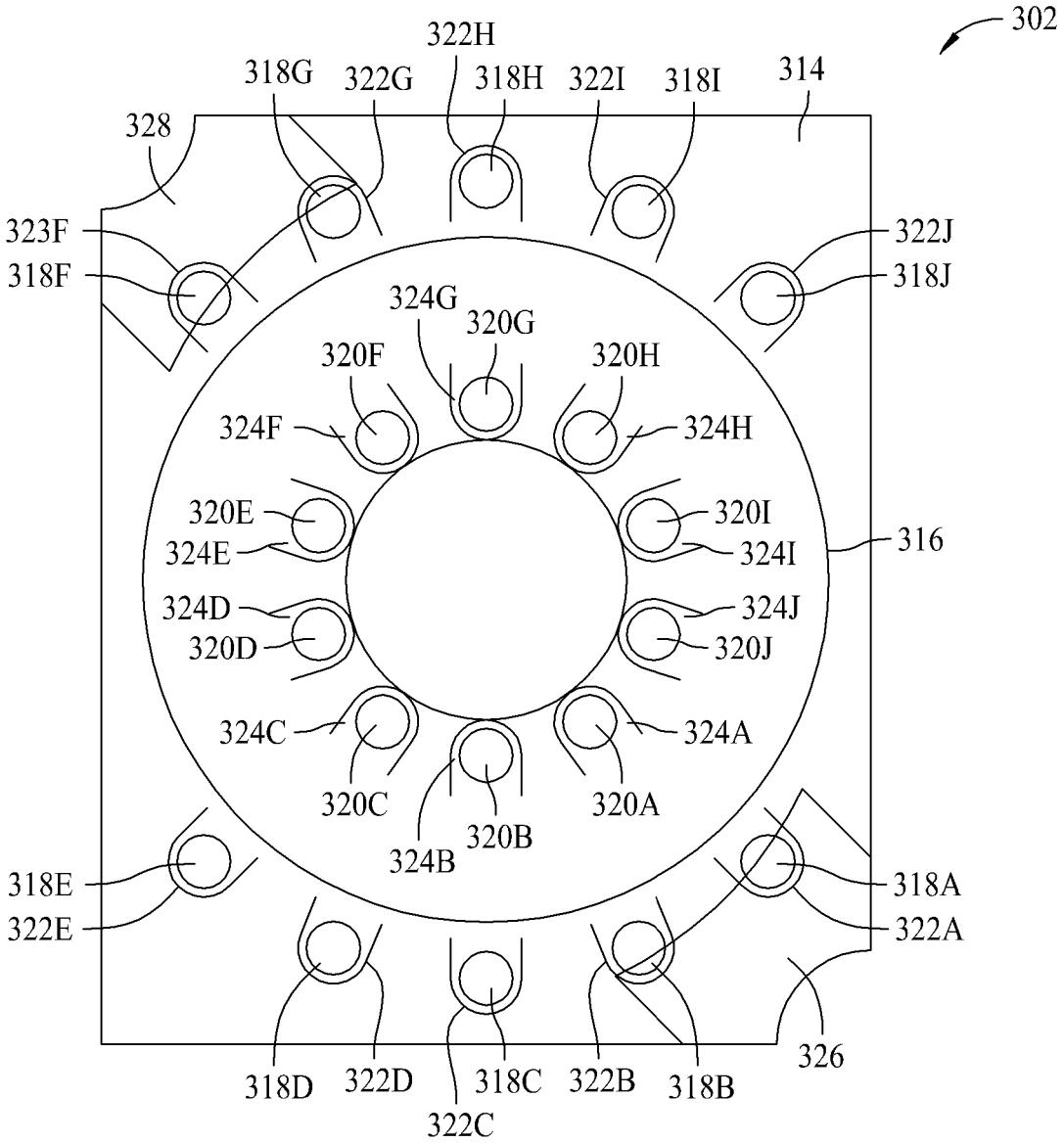
FIG. 8 is a schematic view of a portion of the component shown in FIGS. 6 and 7.

Additionally, each of the coil layers 302 includes termination openings 318 that may be selectively filled with a conductive material to interconnect the coil windings 316 of the coil layers 302 in series with one another in the manner explained below. The openings 318 may, for example, be punched, drilled or otherwise formed in the coil layer 402 proximate the outer periphery of the winding 316. As schematically illustrated in FIG. 8, each coil layer 302 includes a number of outer coil termination openings 318A, 318B, 318C, 318D, 318E, 318F, 318G, 318H, 318I, 318J. In an exemplary embodiment, the number of termination openings 318 is the same as the number of coil layers 302, although more or less termination openings 318 could be provided with similar effect in an alternative embodiment.

Likewise, each coil layer 302 includes a number of inner coil termination openings 320A, 320B, 320C, 320D, 320E, 320F, 320G, 320H, 320I, 320J, that likewise may be punched, drilled or otherwise formed in the coil layers 302. The number of inner termination openings 320 is the same as the number of outer termination openings 318 in an exemplary embodiment, although the relative numbers of inner and outer termination openings 320 and 318 may varied in other embodiments. Each of the outer termination openings 318 is connectable to an outer region of the coil 316 by an associated circuit trace 322A, 322B, 322C, 322D, 322E, 322F, 322G, 322H, 322I, and 322J. Each of the inner termination openings 320 is also connectable to an inner region of the coil 316 by an associated circuit trace 324A, 324B, 324C, 324D, 324E, 324F, 324G, 324H, 324I, and 324J. Each coil layer 302 also includes termination pads 326, 328 and a central core opening 330.

In an exemplary embodiment, for each of the coil layers 302, one of the traces 322 associated with one of the outer termination openings 318 is actually present, and one of the traces 324 associated with one of the inner termination openings 322 is actually present, while all of the outer and inner termination openings 318 and 320 are present in each layer. As such, while a plurality of outer and inner termination openings 318, 320 are provided in each layer, only a single termination opening 318 for the outer region of the coil winding 316 in each layer 302 and a single termination opening 320 for the inner region of each coil winding 316 is actually utilized by forming the associated traces 322 and 324 for the specific termination openings 318, 320 to be utilized. For the other termination openings 318, 320 that are not to be utilized, connecting traces are not formed in each coil layer 302.

As illustrated in FIG. 7, the coil layers 302 are arranged in pairs wherein the termination points established by one of the termination openings 318 and 320 and associated traces in a pair of coil winding portions 316A and 316B, such as in the coil layers 302A and 302B, are aligned with one another to form a connection. An adjacent pair of coil layers in the stack, however, such as the coil layers 302C and 302D, has termination points for the coil winding portions 316C and 316D, established by one of the termination openings 318 and 320 and associated traces in the coil layers of the pair, that are staggered in relation to adjacent pairs in the coil module 301. That is, in the illustrated embodiment, the termination points for the coil layers 302C and 302D are staggered from the termination points of the adjacent pairs 316A, 316B and the pair 316E and 316F. Staggering of the termination points in the stack prevents electrical shorting of the coil winding portions 316 in adjacent pairs of coil layers 302, while effectively providing for a series connections of all of the coil winding portions 316 in each coil layer 302A, 302B, 302C, 302D, 302E, 302F, 302G, 302H, 302I and 302J.

When the coil layers 302 are stacked, the inner and outer termination openings 318 and 320 formed in each of the base layers 314 are aligned with another, forming continuous openings throughout the stacked coil layers 302. Each of the continuous openings may be filled with a conductive material, but because only selected ones of the openings 318 and 320 include a respective conductive trace 322 and 324, electrical connections are established between the coil winding portions 316 in the coil layers 302 only where the traces 322 and 324 are present, and fail to establish electrical connections where the traces 322 and 324 are not present.

In the embodiment illustrated in FIG. 7, ten coil layers 302A, 302B, 302C, 302D, 302E, 302F, 302G, 302H, 302I and 302J are provided, and each respective coil winding portion 316 in the coil layers 302 includes two turns in the illustrated embodiment. Because the coil winding portions 316A, 316B, 316C, 316D, 316E, 316F, 316G, 316H, 316I and 316J are connected in series, twenty total turns are provided in the stacked coil layers 302. A twenty turn coil may produce an inductance value of about 4 to 5 μH in one example, rendering the inductor 100 well suited as a power inductor for low power applications. The component 300 may alternatively be fabricated, however, with any number of coil layers 302, and with any number of turns in each winding portion of the coil layers to customize the coil for a particular application or end use.

The upper and lower dielectric layers 304, 306, and the base dielectric layers 314 may be fabricated from polymer based metal foil materials as described above with similar advantages. The coil winding portions 316 may be formed any manner desired, including the techniques described above, also providing similar advantages and effects. The coil layers 302 may be provided in module form, and depending on the number of coil layers 302 used in the stack, inductors of various ratings and characteristics may be provided. Because of the stacked coil layers 302, the inductor 300 has a greater low profile dimension H (about 0.5 mm in an exemplary embodiment) in comparison to the dimension H of the component 100 (about 0.15 mm in an exemplary embodiment), but is still small enough to satisfy many low profile applications for use on stacked circuit boards and the like.

Figure 9:
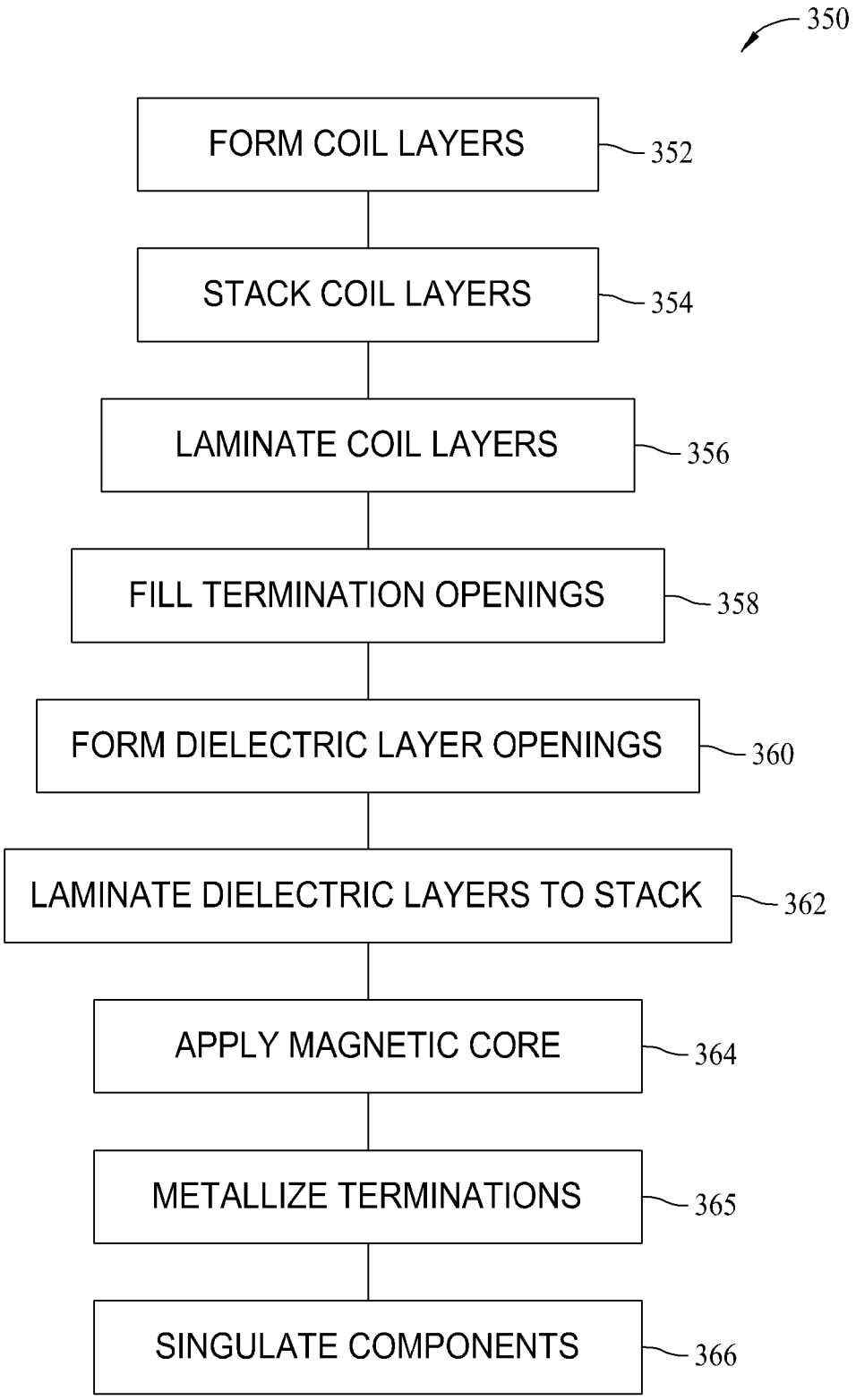
FIG. 9 is a method flowchart of a method of manufacturing the component shown in FIGS. 6-8.

The construction of the component 300 also lends itself to subassemblies that may be separately provided and assembled to one another according the following method 350 illustrated in FIG. 9.

The coil windings may be formed in bulk on a larger piece of a dielectric base layer to form 352 the coil layers 302 on a larger sheet of dielectric material. The coil windings may be formed in any manner described above or according to other techniques known in the art. The core openings 330 may be formed into the sheet of material before or after forming of the coil windings. The coil windings may be double sided or single sided as desired, and may be formed with additive electro-formation techniques or subtractive techniques on a metallized surface. The coil winding portions 316, together with the termination traces 322, 324 and termination pads 326, 328 are provided on the base layer 314 in each of the coil layers 302. Once the coil layers 302 are formed in step 352, the coil layers 302 may be stacked 354 and laminated 356 to form coil layer modules. The termination openings 318, 320 may be provided before or after the coil layers 302 are stacked and laminated. After they are laminated 356, the termination openings 318, 320 of the layers may be filled 358 to interconnect the coils of the coil layers in series in the manner described above.

The dielectric layers 304 and 306 may also be formed 360 from larger pieces or sheets of dielectric material, respectively. The core openings 310, 312 in the dielectric layers 304, 306 may be formed in any known manner, including but not limited to punching or drilling techniques, and in an exemplary embodiment the core openings 310, 312 are formed prior to assembly of the dielectric layers 304 and 306 to the coil layer modules.

The outer dielectric layers 304 and 306 may then be stacked and laminated 362 to the coil layer module. Magnetic core material may be applied 364 to the laminated stack to form the magnetic cores. After curing the magnetic material, the stacked sheets may be cut, diced, or otherwise singulated 366 into individual inductor components 300. Before or after singulation of the components, vertical surfaces of the terminations 305, 307 (FIG. 7) may be metallized 365 via, for example, a plating process, to complete the components 300.

With the layered construction and the method 350, magnetic components such as inductors and the like may be provided quickly and efficiently, while still retaining a high degree of control and reliability over the finished product. By pre-forming the coil layers and the dielectric layers, greater accuracy in the formation of the coils and quicker assembly results in comparison to known methods of manufacture. By forming the core over the coils in the core openings once the layers are assembled, separately provided core structures, and manufacturing time and expense, is avoided. By embedding the coils into the core, a separate application of a winding to the surface of the core is also avoided. Low profile inductor devices may therefore be manufactured at lower cost and with less difficulty than known methods for manufacturing magnetic devices.

It is contemplated that greater or fewer layers may be fabricated and assembled into the component 300 without departing from the basic methodology described above. Using the above described methodology, magnetic components may be efficiently formed using low cost, widely available materials in a batch process using relatively inexpensive known techniques and processes. Additionally, the methodology provides greater process control in fewer manufacturing steps than conventional component constructions. As such, higher manufacturing yields may be obtained at a lower cost.

For the reasons set forth above, the inductor 300 and method 350 is believed to be avoid manufacturing challenges and difficulties of known constructions and is therefore manufacturable at a lower cost than conventional magnetic components while providing higher production yields of satisfactory devices.

IV. Further Adaptations

The concepts disclosed above are further extended in the following exemplary embodiments, providing additional benefits and advantages over conventional magnetic component assemblies, including but not limited tom miniaturized inductors and transformer components. Specifically, and as explained below, instead of using dielectric layers as described above to form low profile magnetic components, magnetic sheet layers may be utilized to provide further performance advantages.

Figure 10A:
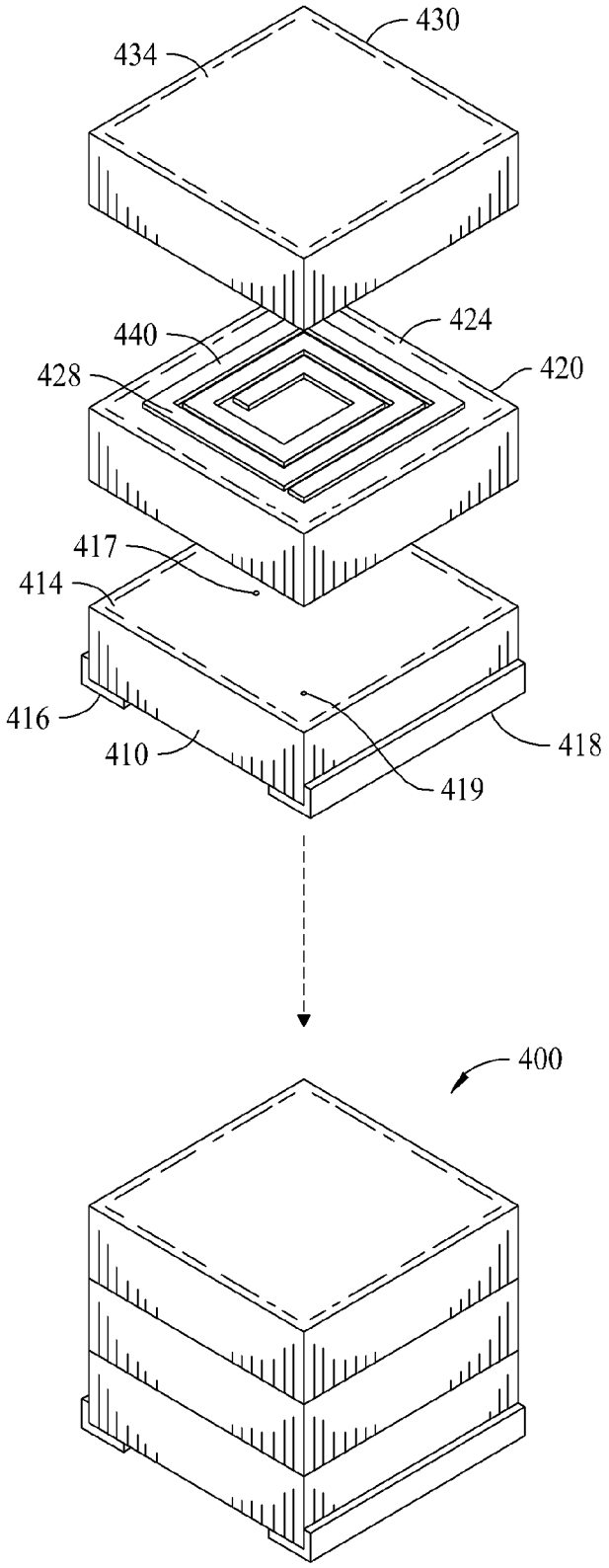
FIG. 10*a* illustrates a perspective view and an exploded view of the top side of an exemplary magnetic component assembly.
Figure 10B:
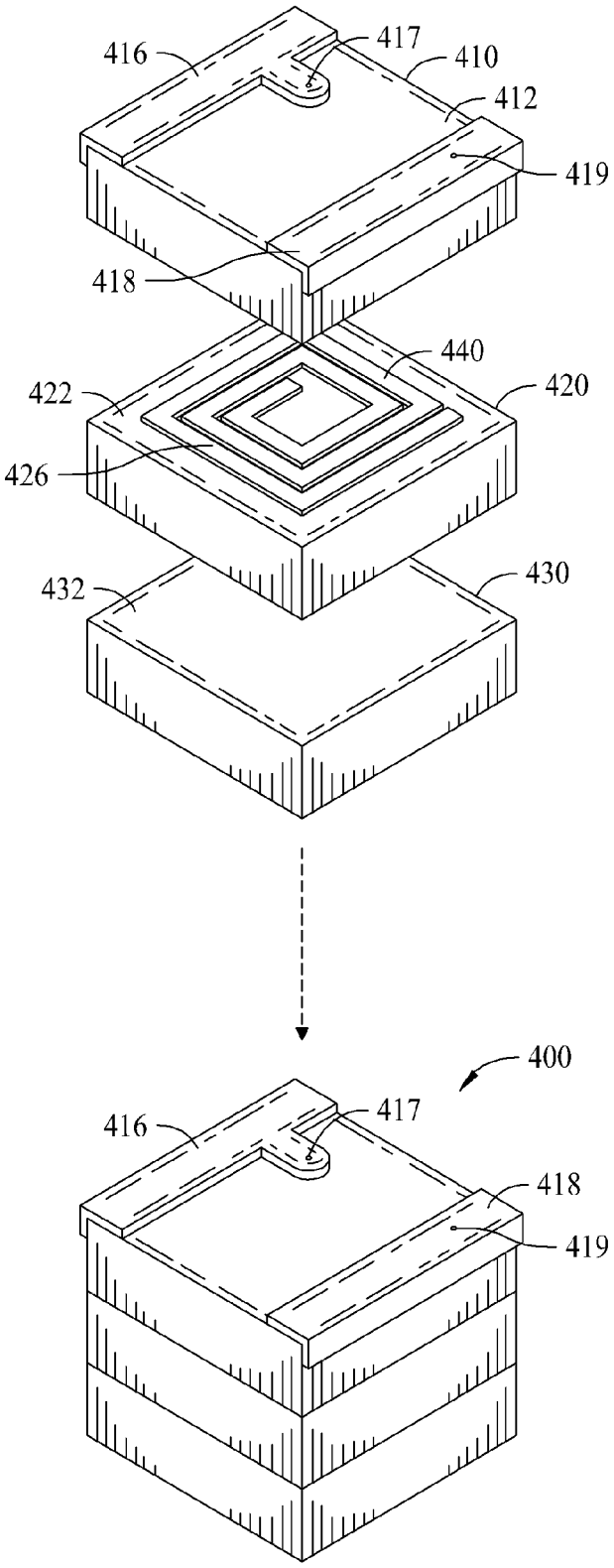
FIG. 10*b* illustrates a perspective view and an exploded view of the bottom side of the magnetic component as depicted in FIG. 10*a*.
Figure 10C:
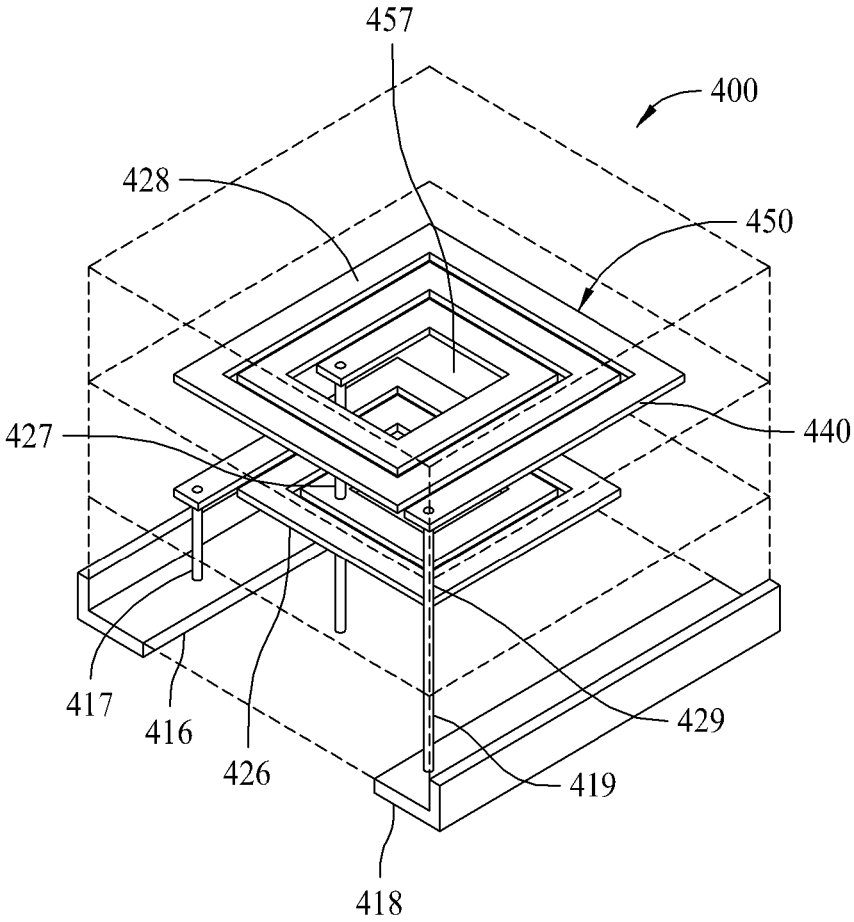
FIG. 10*c* illustrates a perspective view of the winding configuration of the magnetic component as depicted in FIG. 10*a* and FIG. 10*b*.

Referring to FIGS. 10*a*-10*c*, several views of a an exemplary magnetic component assembly 400 are shown. FIG. 10*a* illustrates a perspective view and an exploded view of the top side of the assembly having a winding in a first winding configuration, at least one magnetic powder sheet and a vertically oriented core area in accordance with an exemplary embodiment. FIG. 10*b* illustrates a perspective view and an exploded view of the bottom side of the assembly as depicted in FIG. 10*a* in accordance with an exemplary embodiment. FIG. 10*c* illustrates a perspective view of the first winding configuraiton of the assembly as depicted in FIG. 10*a* and FIG. 10*b* in accordance with an exemplary embodiment.

According to the exemplary embodiment shown, the component assembly 400 includes at least one magnetic powder sheet 410, 420, 430 and a winding 440 coupled to the at least one magnetic powder sheet 410, 420, 430 in a first winding configuration 450. As seen in this embodiment, the assembly 400 comprises a first magnetic powder sheet 410 having a lower surface 412 and an upper surface 414, a second magnetic powder sheet 420 having a lower surface 422 and an upper surface 424, and a third magnetic powder sheet 430 having a lower surface 432 and an upper surface 434, In an exemplary embodiment, each magnetic powder sheet can be a magnetic powder sheet manufactured by Chang Sung Incorporated in Incheon, Korea and sold under product number 20u-eff Flexible Magnetic Sheet, Also, these magnetic powder sheets have grains which are dominantly oriented in a particular direction. Thus, a higher inductance may be achieved when the magnetic field is created in the direction of the dominant grain orientation. Although this embodiment depicts three magnetic powder sheets, the number of magnetic sheets may be increased or reduced so as to increase or decrease the number of turns in the winding or to increase or decrease the core area without departing from the scope and spirit of the exemplary embodiment. Also, although this embodiment depicts a magnetic powder sheet, any flexible sheet may be used that is capable of being laminated, without departing from the scope and spirit of the exemplary embodiment.

The first magnetic powder sheet 410 also includes a first terminal 416 and a second terminal 418 coupled to opposing longitudinal edges of the lower surface 412 of the first magnetic powder sheet 410. These terminals 416, 418 may be used to couple the miniature power inductor 400 to an electrical circuit, which may be on a printed circuit board (not shown), for example. Each of the terminals 416, 418 also comprises a via 417, 419 for coupling the terminals 416, 418 to one or more winding layers, which will be further discussed below. The vias 417, 419 are conductive connectors which proceed from the terminals 416, 418 on the lower surface 412 to the upper surface 414 of the first magnetic powder sheet 410. The vias may be formed by drilling a hole through the magnetic powder sheets and plating the inner circumference of the drilled hole with conductive material. Alternatively, a conductive pin may be placed into the drilled holes to establish the conductive connections in the vias.

Although the vias 417, 419 are shown to be cylindrical in shape, the vias may be a different geometric shape, for example, rectangular, without departing from the scope and spirit of the exemplary embodiment. In one exemplary embodiment, the entire assembly can be formed and pressed before drilling the vias, Although the terminals are shown to be coupled to opposing longitudinal edges, the terminals may be coupled at alternative locations on the lower surface of the first magnetic powder sheet without departing from the scope and spirit of the exemplary embodiment. Also, although each terminal is shown to have one via, additional vias may be formed in each of the terminals so as to position the one or more winding layers in parallel, rather than in series, depending upon the application, without departing from the scope and spirit of the exemplary embodiment.

The second magnetic powder sheet 420 has a first winding layer 426 coupled to the lower surface 422 and a second winding layer 428 coupled to the upper surface 424 of the second magnetic powder sheet 420. Both winding layers 426, 428 combine to form the winding 440. The first winding layer 426 is coupled to the terminal 416 through the via 417. The second winding layer 428 is coupled to the first winding layer 426 through via 427, which is formed in the second magnetic powder sheet 420. Via 427 proceeds from the lower surface 422 to the upper surface 424 of the second magnetic powder sheet 420. The second winding layer 428 is coupled to the second terminal 418 through vias 429, 419. Via 429 proceeds from the upper surface 424 to the lower surface 422 of the second magnetic powder sheet 420. Although two winding layers are shown to be coupled to the second magnetic powder sheet in this embodiment, there may be one winding layer coupled to the second magnetic powder sheet without departing from the scope and spirit of the exemplary embodiment.

The winding layers 426, 428 are formed from a conductive metal layer, which may be copper or another material such as those described above, which is coupled to the second magnetic powder sheet 420. This conductive metal layer may be provided in various ways, including but not limited to any of the elements described above (e.g., electroformed elements, screen printed elements, etc.), a stamped copper foil, an etched copper trace, or a preformed coil without departing from the scope and spirit of the exemplary embodiment. The etched copper trace may be formed utilizing, but is not limited to, chemical processes, photolithography techniques, or by laser etching techniques. As shown in this embodiment, the winding layer is a rectangular-shaped spiral pattern. However, other patterns may be used to form the winding without departing from the scope and spirit of the exemplary embodiment. Although copper is used as the conductive material in an exemplary embodiment, other conductive materials may be used without departing from the scope and spirit of the exemplary embodiment. The terminals 416, 418 may also be formed using a stamped copper foil, an etched copper trace, or by any other suitable method.

The third magnetic powder sheet 430, according to this embodiment, is placed on the upper surface 424 of the second magnetic powder sheet 420 so that the second winding layer 428 may be insulated and also so that the core area may be increased for handling higher current flow.

Although the third magnetic powder sheet is not shown to have a winding layer, a winding layer may be added to the lower surface of the third magnetic layer in lieu of the winding layer on the upper surface of the second magnetic powder sheet without departing from the scope and spirit of the exemplary embodiment. Additionally, although the third magnetic powder sheet is not shown to have a winding layer, a winding layer may be added to the upper surface of the third magnetic layer without departing from the scope and spirit of the exemplary embodiment.

Upon forming each of the magnetic powder sheets 410, 420, 430 with the winding layers 426, 428 and/or terminals 416, 418, the sheets 410, 420, 430 are pressed with high pressure, for example, hydraulic pressure, and laminated together to form the miniature power inductor 400. After the sheets 410, 420, 430 have been pressed together, the vias are formed, as previously discussed. According to this embodiment, the physical gap between the winding and the core, which is typically found in conventional inductors, is removed. The elimination of this physical gap tends to minimize the audible noise from the vibration of the winding.

The component assembly 400 is depicted as a cube shape. However, other geometrical shapes, including but not limited to rectangular, circular, or elliptical shapes, may be used without departing from the scope and spirit of the exemplary embodiment.

The winding 440 includes a first winding layer 426 and a second winding layer 428 and forms a first winding configuration 450 having a vertically oriented core 457. The first winding configuration 450 starts at the first terminal 416, then proceeds to the first winding layer 426, then proceeds to the second winding layer 428, and then proceeds to the second terminal 418. Thus, in this embodiment, the magnetic field may be created in a direction that is perpendicular to the direction of grain orientation and thereby achieve a lower inductance or the magnetic field may be created in a direction that is parallel to the direction of grain orientation and thereby achieve a higher inductance depending upon which direction the magnetic powder sheet is extruded.

A variety of winding configurations, oriented vertically or horizontally in the component assembly, may likewise be utilized as described in the related U.S. application Ser. No. 12/181,436 identified above that has been incorporated by reference herein. Also, the number of magnetic layers and coil layers may vary considered in different embodiments. While assemblies such as the assembly 400 are believed to be particularly advantageous for miniature power inductor components, it is recognized that other types of components may also be beneficially provided using similar techniques, including miniature transformer components.

Figure 11:
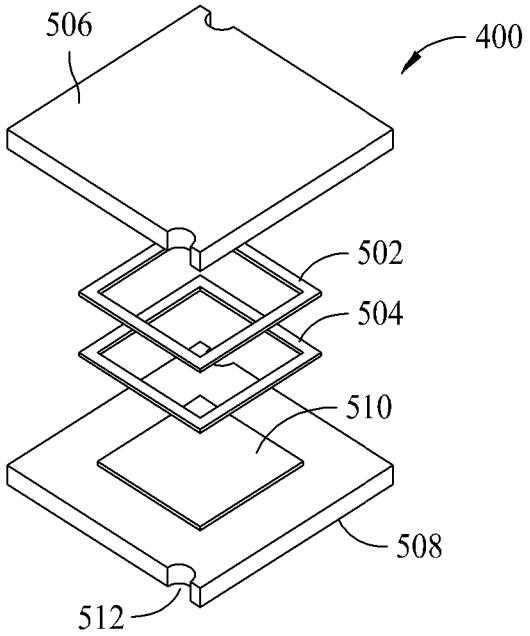
FIG. 11 is an exploded view of another magnetic component assembly formed in accordance with an exemplary embodiment of the invention.

FIG. 11 illustrates a magnetic component assembly 500 including coils 502, 504 fabricated using flexible circuit board techniques. Layers of magnetic material 506, 508 such as those described above or below, may be pressed around and coupled to the coils 502, 504 to define a magnetic body containing the coils 502, 504.

While two coils 502, 504 are illustrated in FIG. 11, it is appreciated that greater or fewer numbers of coils may be provided in other embodiments. Additionally, while generally square shaped coils 502, 504 are shown in FIG. 11, other shapes of coils are possible and could be utilized. The flexible printed circuit coils 502, 504 may be positioned in a flux sharing relationship within the magnetic body.

The flexible circuit coils 502, 504 may be electrically connected via termination pads 510 and metalized openings 512 in the sides of the magnetic body in one example, although other termination structure may alternatively be used in other embodiments.

Figure 12:
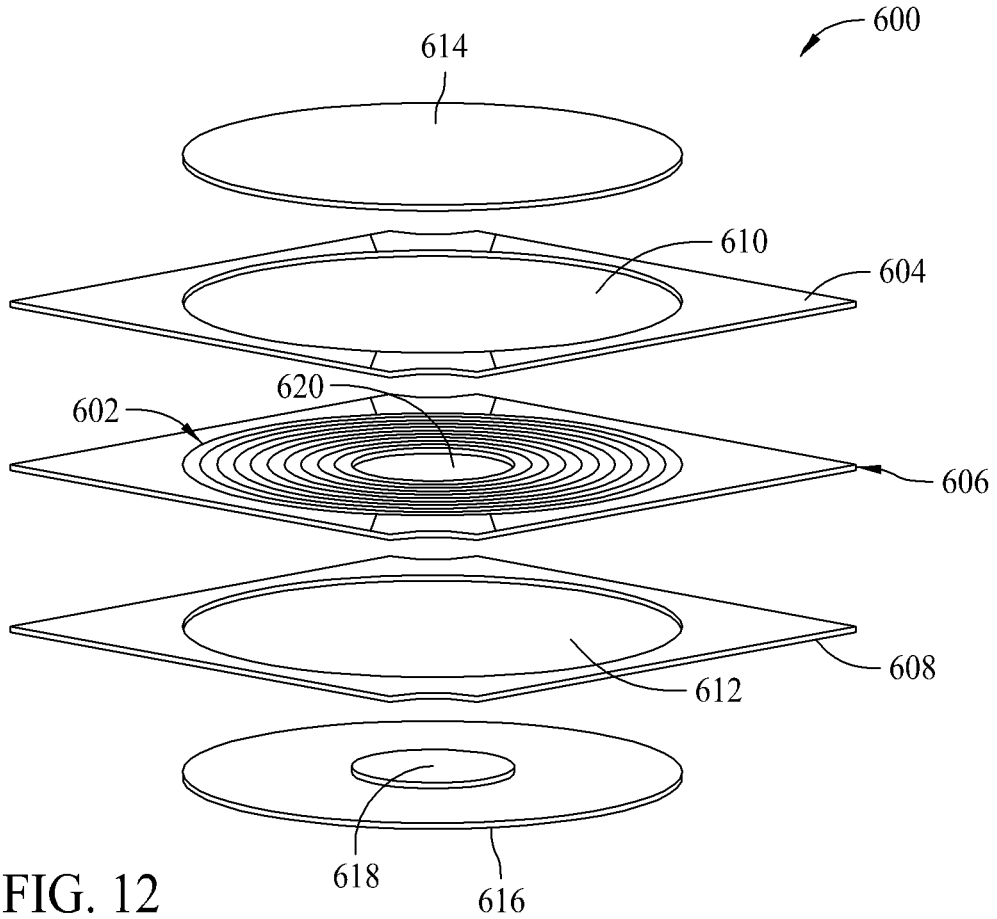
FIG. 12 is an exploded view of a seventh exemplary magnetic component assembly formed in accordance with an exemplary embodiment of the invention.

FIG. 12 illustrates another magnetic component assembly 600 including a flexible printed circuit coil 602 and moldable magnetic material layers 604, 606 and 608. The magnetic materials may be moldable, and may be fabricated from any of the materials discussed above. The magnetic material layers may be pressed around the flexible printed circuit coil 602 and secured thereto.

Unlike the assembly 500 shown in FIG. 11, the assembly 600 includes, as shown in FIG. 12, openings 610, 612 formed in the layers 604, 608. The openings 610, 612 receive shaped core elements 614, 616 that may be fabricated from a different magnetic material than the magnetic layers 604, 606 and 608. The core element 616 may include a center boss 618 that extends through an opening 620 in the coil 602. The core elements 614 and 616 may be provided before or after the magnetic body is formed with the magnetic layers.

It is recognized that greater or fewer numbers of layers may be provided in other embodiments than shown in FIG. 12. Additionally, more than one coil 602 could be provided, and the coils 602 may be double-sided. Various shapes of coils may be utilized.

While the embodiments shown in FIGS. 11 and 12 are fabricated from magnetic layers, they alternatively could be fabricated from magnetic powder materials directly pressed around the flexible printed circuit coils without first being formed into layers as described above.

In an exemplary embodiment each of the magnetic layers 604, 606 and 608 is fabricated from a moldable magnetic material which may be, for example, a mixture of magnetic powder particles and a polymeric binder having distributed gap properties as those in the art will no doubt appreciate.

The magnetic powder particles used to form the magnetic layers 604, 606 and 608 may be, in various embodiments, Ferrite particles, Iron (Fe) particles, Sendust (Fe—Si—Al) particles, MPP (Ni—Mo—Fe) particles, HighFlux (Ni—Fe) particles, Megaflux (Fe—Si Alloy) particles, iron-based amorphous powder particles, cobalt-based amorphous powder particles, or other equivalent materials known in the art. When such magnetic powder particles are mixed with a polymeric binder material the resultant magnetic material exhibits distributed gap properties that avoids any need to physically gap or separate different pieces of magnetic materials. As such, difficulties and expenses associated with establishing and maintaining consistent physical gap sizes are advantageously avoided. For high current applications, a pre-annealed magnetic amorphous metal powder combined with a polymer binder is believed to be advantageous.

In different embodiments, the magnetic layers 604, 606 and 608 may be fabricated from the same type of magnetic particles or different types of magnetic particles. That is, in one embodiment, all the magnetic layers 604, 606 and 608 may be fabricated from one and the same type of magnetic particles such that the layers 604, 606 and 608 have substantially similar, if not identical, magnetic properties. In another embodiment, however, one or more of the layers 604, 606 and 608 could be fabricated from a different type of magnetic powder particle than the other layers. For example, the inner magnetic layers 606 may include a different type of magnetic particles than the outer magnetic layers 604 and 608, such that the inner layer 606 has different properties from the outer magnetic layers 604 and 608. The performance characteristics of completed components may accordingly be varied depending on the number of magnetic layers utilized and the type of magnetic materials used to form each of the magnetic layers.

Various embodiments of magnetic components have been described including magnetic body constructions and coil constructions that provide manufacturing and assembly advantages over existing magnetic components. As will be appreciated below, the advantages are provided at least in part because of the magnetic materials utilized which may be molded over the coils, thereby eliminating assembly steps of discrete, gapped cores and coils. Also, the magnetic materials have distributed gap properties that avoids any need to physically gap or separate different pieces of magnetic materials.

Additionally, the magnetic material is beneficially moldable into a desired shape through, for example, compression molding techniques or other techniques to coupled the layers to the coil and to define the magnetic body into a desired shape. The ability to mold the material is advantageous in that the magnetic body can be formed around the coil layer(s) in an integral or monolithic structure including the coil, and a separate manufacturing step of assembling the coil(s) to a magnetic structure is avoided. Various shapes of magnetic bodies may be provided in various embodiments.

The moldable magnetic material defining the magnetic bodies may be any of the materials mentioned above or other suitable materials known in the art. While magnetic powder materials mixed with binder are believed to be advantageous, neither powder particles nor a non-magnetic binder material are necessarily required for the magnetic material forming the magnetic body. Additionally, the moldable magnetic material need not be provided in sheets or layers as described above, but rather may be directly coupled to the coils using compression molding techniques or other techniques known in the art.

FIGS. 13-17 illustrate still other features providing magnetic component assemblies having further performance advantages. Specifically, separately provided core pieces may be combined with magnetic powder materials to provide magnetic component assemblies having desired performance characteristics.

Figure 13:
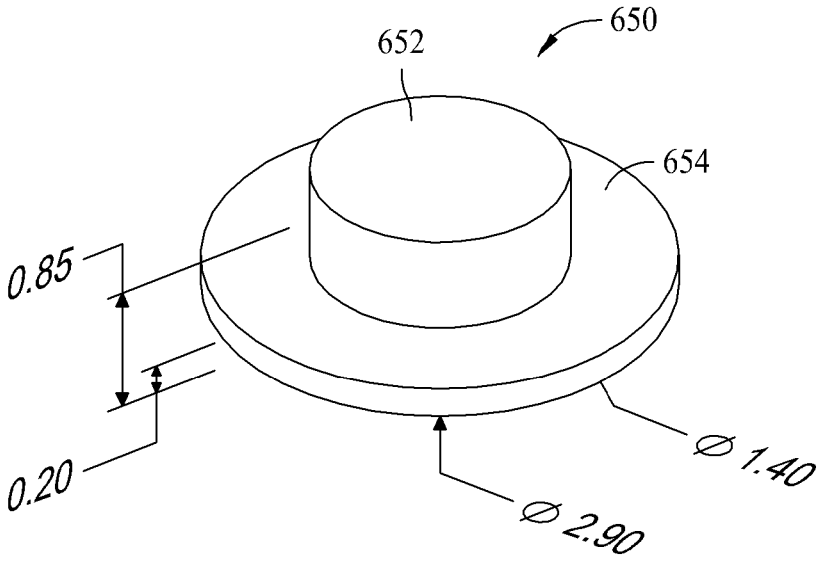
FIG. 13 is a perspective view of an exemplary drum core formed in accordance with an exemplary embodiment of the invention.

FIG. 13 illustrates an exemplary drum core 650 including a generally cylindrical center portion 652 and a generally annular flange portion 654 extending from one end of the cylindrical center portion 654. The drum core 650 shown is therefore similar in shape to the core element 108 and 616 shown in FIGS. 2 and 12, respectively. The proportions of the drum core 650 and the core pieces 108 and 616, however, are different as the figures show. Specifically, the drum core 650 is more compact (i.e., has a smaller diameter), has greater thickness in the annular flange portion 654, and the cylindrical center portion 652 is taller relative to the corresponding portions of the core pieces 108 and 616. Exemplary dimensions of the drum core 650 are shown in FIG. 13 in units of millimeters, although it understood that the dimensions may vary in further and/or alternative embodiments.

The drum core 650 may be fabricated from any of the materials discussed above or known in the art. The cores 650 may further be fabricated using known techniques, including but not limited to compression molding techniques and the like. The drum core 650 may further be fabricated from layers of materials or may have a non-layered construction. One or more different types of material may be utilized to fabricate the drum core to provide varying magnetic properties and electrical characteristics for the drum core.

Figure 14:
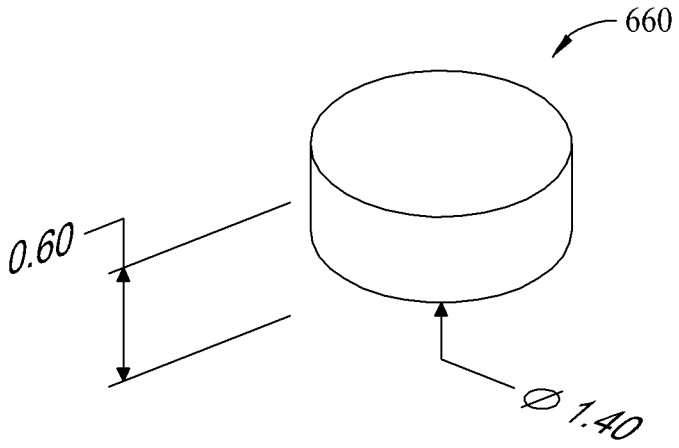
FIG. 14 is a perspective view of a first exemplary rod core formed in accordance with an exemplary embodiment of the invention.
Figure 15:
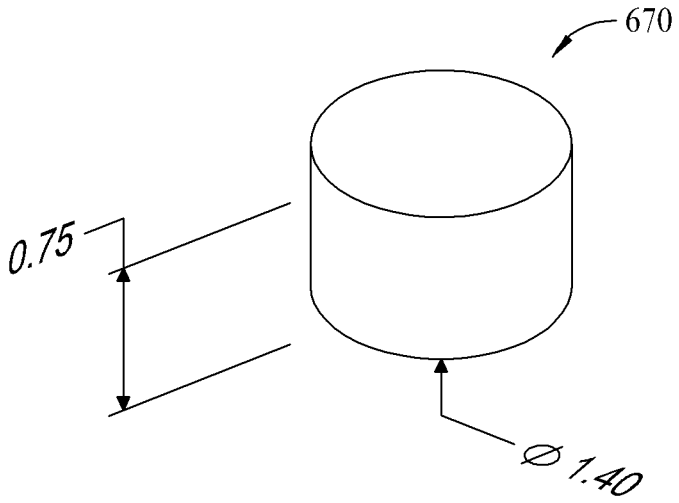
FIG. 15 is perspective view of a second exemplary rod core formed in accordance with an exemplary embodiment of the invention.

FIGS. 14 and 15 illustrate exemplary rod cores 660 and 670 that include generally cylindrical bodies without an annular flange 654 (FIG. 13) as in the drum core 650. In the depicted embodiments in FIGS. 14 and 15, the rod cores 660 and 670 are truncated to meet low profile requirements and thus are disk-like shapes resembling hockey pucks. Exemplary dimensions of the rod cores 660 and 670 are shown in FIGS. 14 and 15 in units of millimeters, although it understood that the dimensions may vary in further and/or alternative embodiments.

Like the drum core 650, the rod cores 660 and 670 may be fabricated from any of the materials discussed above or known in the art. The cores 650 may further be fabricated using known techniques, including but not limited to compression molding techniques and the like. The rod cores 660 and 670 may further be fabricated from layers of materials or may have a non-layered construction. One or more different types of material may be utilized to fabricate the drum core to provide varying magnetic properties and electrical characteristics for the rod cores.

Figure 16:
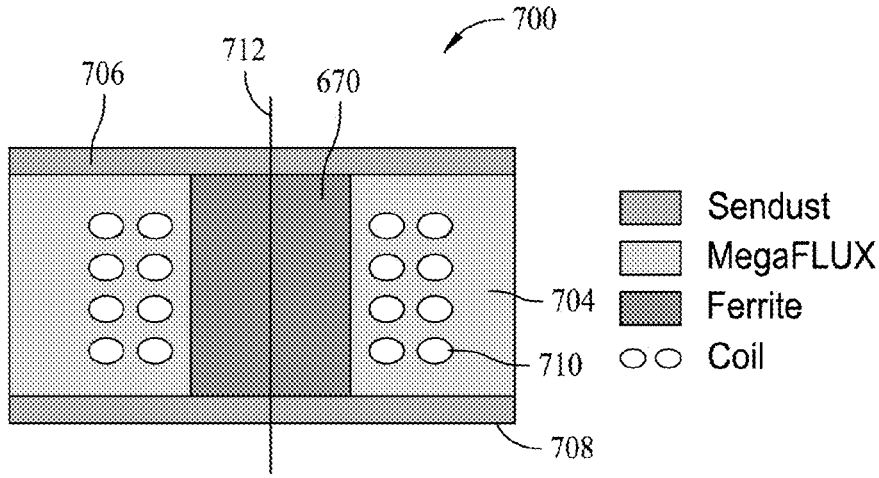
FIG. 16 is a sectional view of a magnetic component assembly including a rod core.

FIG. 16 is a sectional view of an exemplary magnetic component assembly 700 including the rod core 670 centrally located in a magnetic body 702 including a center coil portion 704 in intimate contact with and sandwiched between outer portions 706 and 708. One or more coils 710 are embedded in the coil portion 704 and the rod core 670 extends through central portions of the coils 710. The outer portions 706 and 708 of the magnetic body 702 opposed one another and effectively envelope and encase the rod core 670, the coils 710 and the magnetic body coil portion 704 therebetween.

The magnetic body 702 including the coil portion 704 and the outer portions 706 and 708 may be fabricated from any of the materials discussed above or known in the art. The body 702 may further be fabricated using known techniques, including but not limited to compression molding techniques and the like. The body 702 may further be fabricated from layers of materials or may have a non-layered construction. One or more different types of material may be utilized to fabricate the magnetic body 702 to provide varying magnetic properties and electrical characteristics.

For example, and as shown in FIG. 16, the coil portion 704 in one embodiment is fabricated from a first magnetic material such as MegaFLUX powder material available from Chang Sung Corporation, either in a layered or non-layered form, and thus exhibits a first set of magnetic and electrical properties in use. The outer portions 706 and 708 of the magnetic body 702, however, are fabricated from a second magnetic material such as Sendust, either in a layered or non-layered form, and thus exhibits a second set of magnetic and electrical properties in use. While in the embodiment shown the outer portions 706 and 708 of the magnetic body 702 are fabricated from the same material and have the same magnetic and electrical properties, it is understood that in another embodiment they too may be fabricated from different electrical materials such that they have different magnetic and electrical properties in use.

As shown in the example of FIG. 16, the rod core 670 is fabricated from a third magnetic material such as a ferrite powder, either in a layered or non-layered form, and thus exhibits a third set of magnetic and electrical properties in use. The rod core 670 extends end-to-end between the outer portions 706 and 708 of the magnetic body 702 in a direction parallel to the longitudinal axis 712 of the assembly 700. As such, no portion of the rod core 670 is exposed to or visible from the exterior of the assembly 700. The rod core 670 is therefore embedded between the outer portions 706 and 708 of the magnetic body.

By virtue of the three different magnetic materials utilized to form the rod core 670, and the coil portion 704 and outer portions 706, 708 of the magnetic body 702, the electrical and magnetic properties of the assembly vary in the different portions of the assembly 700 by virtue of the distinct and different materials utilized and their differing electrical characteristics. Considerable performance advantages may ensue and the assembly 700 may perform at a level not otherwise possible in comparison to conventional magnetic component instructions involving one material, for example. The assembly 700 may also be strategically configured with the different magnetic materials to achieve a level of performance not possible relative to the other embodiments disclosed herein.

While specific magnetic materials have been identified above for forming the rod core 670, and the coil portion 704 and outer portions 706, 708 of the magnetic body 702, they are exemplary only and other materials may likewise be used to accomplish similar objectives in varying the magnetic and electrical performance of the assembly 700.

Further performance variations are of course possible by varying the types and characteristics of the coils 710 utilized in the body 702 and surrounding the rod core 670. Any of the coil types described above may be utilized. That is, pre-formed coil layers may be provided on dielectric base layers, pre-formed coils may be fabricated using flexible printed circuit board techniques, or pre-formed wire coils may be fabricated from wire conductors wound into coils for a number of turns. By varying the type of coil used and the configuration of the windings, different inductance values, for example, may be achieved. However formed, the coils 710 may be terminated in any manner described above or known in the art to establish electrical path to an exterior of the magnetic body 702 such that the assembly 700 may be surface mounted to a circuit board to establish an electrical circuit through the coils 710.

The assembly 700 may be manufactured with a multi-stage fabrication and assembly process. That is, in an exemplary embodiment the rod core 670 and the embedded coil(s) 710 in the magnetic body coil portion 704 may be separately fabricated and assembled to one another. In one such embodiment, the magnetic body coil portion 704 may be formed with a central opening or bore extending therethrough may be formed, and a pre-fabricated rod core 670 may be extended through the core. In another embodiment, the rod core 670 may be formed in the central opening or bore of the magnetic body coil portion 704 using injection molding techniques and the like without being pre-fabricated. The magnetic body outer portions 706 and 708 may subsequently be formed on the ends of the magnetic body coil portion 704 and rod core 670 assembly using compression molding techniques and the like. Terminations may then be completed. The assembly 700 is therefore more complicated from a manufacturing perspective as some of the previous embodiments disclosed, but the performance advantages may very well outweigh any increased manufacturing costs relative to other embodiments described herein.

The low profile dimensions of the assembly 700 may further be varied, for example, by using a smaller rod core, such as the rod core 660 shown in FIG. 14. The size of the rod core utilized also affects the overall performance parameters of the assembly in use.

Figure 17:
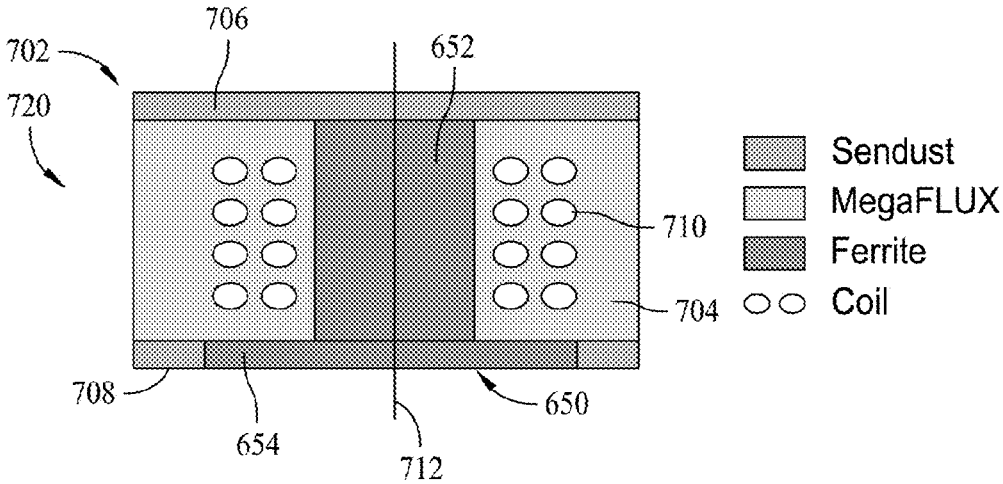
FIG. 17 is a sectional view of another magnetic component assembly including a drum core.

FIG. 17 illustrates another magnetic component assembly 720 that is similar to the assembly 700 described above, but utilizes the drum core 650 (FIG. 13) in lieu of the rod core 670 (FIG. 16). The drum core 650 and its annular flange 654 (FIG. 13) provides additional magnetic material of the first type than does a rod core, and thus changes the magnetic and electrical performance of the assembly 720 versus a comparable sized assembly 700.

As shown in FIG. 17, the annular flange 645 of the drum core 650 is generally exposed through the outer portion 708 on end of the magnetic body 702, while the opposite end of the central portion 652 extends to but not through the outer portions 706 of the magnetic body 702. As such, the end of the drum core central portion 652 is not exposed to or visible from the exterior of the assembly 720. The drum core central portion 652 is therefore embedded between the outer portions 706 and 708 of the magnetic body while generally extending end-to-end between the annular flange 654 and the outer portion 706 in a direction parallel to the longitudinal axis 712 of the assembly 720.

It is recognized that certain features of the embodiments described could be combined with still other features of embodiments described to provide still other variations within the scope of the present disclosure. For example, where dielectric layers are described, magnetic layers may be utilized instead, or combinations of magnetic and dielectric layers may be utilized. Where magnetic sheets are described, magnetic powder material may be utilized instead. Any of the foregoing coil or winding layers or configurations may be utilized in combination with magnetic or dielectric bodies. Any of the termination techniques described in relation to any of the described embodiments could be utilized with other of the embodiments described. Such variations shall be considered to be in the scope and spirit of the invention unless specifically excluded by the appended claims.

IV. Conclusion

The benefits and advantages of the invention are now believed to be amply demonstrated.

An embodiment of a magnetic component assembly has been disclosed including: at least one coil defining a coil winding having a center area and a number of turns extending about the center area; a body enclosing and embedding the coil layer, wherein the body is fabricated from one of a dielectric material and a magnetic material, and a magnetic core material occupying at least the center area of the coil layer and a center area of the body, wherein the electrical and magnetic properties of the body and the magnetic core material are different from one another.

Optionally, the body includes a first layer, the first layer including a core opening defining a receptacle for the introduction of a magnetic core material. The body may further include a second layer, and both of the first and second layers may include a core opening extending therethrough. The at least one coil layer may include a core opening extending therethrough in the center area. The magnetic core material may comprise a magnetic core element separately provided from the first and second layers, with the magnetic core element extending through the core openings of the first and second magnetic sheets and the core opening of the at least one coil layer. Both of the first and second layers comprise a magnetic material, with the magnetic core material of the first and second layers having different magnetic properties from the magnetic core element. The magnetic core material may be formed into one of a drum core and a rod core.

The body may comprise a coil portion fabricated from a first magnetic material and outer portions fabricated from a second magnetic material, with the second magnetic material having different magnetic properties than the first magnetic material. The magnetic core material may also be fabricated from a third magnetic material, the third magnetic material having different magnetic properties than the first and second magnetic materials. The magnetic core material may include a center portion that is substantially entirely embedded between the outer portions of the magnetic body.

Also optionally, the at least one coil layer may be a double sided coil, and may be a flexible circuit coil. The flexible circuit coil may include at least one termination pad. The at least coil may include a plurality of spaced apart coil layers. The spaced apart coil layers may be connected by at least one via.

The body may include a first layer, with the first layer comprising a polymer-based film. The polymer-based film may be a polyimide film or a liquid crystal polymer. The at least one coil layer may be an electroformed coil winding formed independently of the first and second layers. The body may include a first layer, with the first layer comprising a moldable magnetic material. The moldable magnetic material may comprise at least one of Ferrite particles, Iron (Fe) particles, Sendust (Fe—Si—Al) particles, MPP (Ni—Mo—Fe) particles, HighFlux (Ni—Fe) particles, Megaflux (Fe—Si Alloy) particles, iron-based amorphous powder particles, cobalt-based amorphous powder particles, and equivalents and combinations thereof. The body may also include a second layer, with the second layer comprising a moldable magnetic material. The moldable magnetic material of the second layer may have different magnetic properties from the moldable magnetic material of the first layer.

The magnetic component assembly may further include surface mount terminations. The component may be an inductor, and more particularly may be a miniaturized inductor. The body may comprise stacked magnetic layers, and the magnetic core material may be provided integrally with the magnetic layers.

While the invention has been described in terms of various specific embodiments, those skilled in the art will recognize that the invention can be practiced with modification within the spirit and scope of the claims.

What is claimed is:

1. A magnetic component assembly comprising:

at least one coil defining a coil winding having a center area and a number of turns extending about the center area;

a laminated body enclosing and embedding the coil, wherein the body is fabricated from one of a dielectric material and a magnetic material; and a magnetic core material occupying at least the center area of the coil and a center area of the body, wherein the electrical and magnetic properties of the laminated body and the magnetic core material are different from one another, and wherein the magnetic core material is in surface engagement with at least a portion of the at least one coil.

2. The magnetic component assembly of claim 1, wherein the laminated body includes a first layer, the first layer including a core opening defining a receptacle for the introduction of the magnetic core material.

3. The magnetic component assembly of claim 2, wherein the laminated body further comprises a second layer, and both of the first and second layers comprise a core opening extending therethrough for the introduction of the magnetic core material.

4. The magnetic component assembly of claim 3, wherein the at least one coil includes a core opening extending therethrough in the center area.

5. The magnetic component assembly of claim 4, wherein the magnetic core material comprises a magnetic core element separately provided from the first and second layers, the magnetic core element extending through the core openings of the first and second magnetic sheets and the core opening of the at least one coil.

6. The magnetic component assembly of claim 5, wherein the magnetic core material is formed into one of a drum core and a rod core.

7. The magnetic component assembly of claim 6, wherein the laminated body comprises a coil portion fabricated from a first magnetic material and outer portions fabricated from a second magnetic material, the second magnetic material having different magnetic properties than the first magnetic material.

8. The magnetic component assembly of claim 7, wherein the magnetic core material is fabricated from a third magnetic material, the third magnetic material having different magnetic properties than the first and second magnetic materials.

9. The magnetic component assembly of claim 6, wherein the magnetic core material includes a center portion that is substantially entirely embedded between the outer portions of the magnetic body.

10. The magnetic component assembly of claim 5, wherein both of the first and second layers comprise a magnetic material, the magnetic core material of the first and second layers having different magnetic properties from the magnetic core element.

11. The component of claim 1, wherein the at least one coil comprises a double sided coil.

12. The magnetic component assembly of claim 1, wherein the at least coil comprises a flexible circuit coil.

13. The magnetic component assembly of claim 12, wherein the flexible circuit coil includes at least one termination pad.

14. The magnetic component assembly of claim 1, wherein the at least coil comprises a plurality of spaced apart coils.

15. The magnetic component assembly of claim 14, wherein the spaced apart coils are connected by at least one via.

16. The magnetic component assembly of claim 1, wherein the laminated body includes a first layer, the first layer comprising a polymer-based film.

17. The magnetic component assembly of claim 16, wherein the polymer-based film is a polyimide film.

18. The magnetic component assembly of claim 1, wherein the laminated body includes a first layer, the first layer comprising a liquid crystal polymer.

19. The magnetic component assembly of claim 1, wherein the at least one coil comprises an electroformed coil winding formed independently of the first and second layers.

20. The magnetic component assembly of claim 1, wherein the laminated body includes a first layer, the first layer comprising a moldable magnetic material.

21. The magnetic component assembly of claim 20, wherein the moldable magnetic material comprises at least one of Ferrite particles, Iron (Fe) particles, Sendust (Fe—Si—Al) particles, MPP (Ni—Mo—Fe) particles, HighFlux (Ni—Fe) particles, Megaflux (Fe—Si Alloy) particles, iron-based amorphous powder particles, cobalt-based amorphous powder particles, and equivalents and combinations thereof.

22. The magnetic component assembly of claim 21, wherein the laminated body includes a second layer, the second layer comprising a moldable magnetic material.

23. The magnetic component assembly of claim 22, wherein the moldable magnetic material of the second layer has different magnetic properties from the moldable magnetic material of the first layer.

24. The magnetic component assembly of claim 1, further comprising surface mount terminations.

25. The magnetic component assembly of claim 1, wherein the component is an inductor.

26. The magnetic component assembly of claim 1, wherein the inductor is a miniaturized inductor.

27. The magnetic component assembly of claim 1, wherein the laminated body comprises stacked magnetic layers, and wherein the magnetic core material is provided integrally with the magnetic layers.

28. The magnetic component assembly of claim 1, wherein the laminated body comprises a plurality of flexible layers of materials joined in surface contact with one another.

29. The magnetic component assembly of claim 28, wherein the plurality of flexible layers comprises a plurality of flexible magnetic sheets.

30. A magnetic component assembly comprising:

at least one coil defining a coil winding having a center area and a number of turns extending about the center area;

a laminated magnetic body enclosing and embedding the coil, wherein the laminated magnetic body is fabricated from a first magnetic material and a second magnetic material having different properties; and a magnetic core material occupying at least the center area of the coil and a center area of the body, wherein the magnetic core material is fabricated from a third magnetic material having different properties from the first and second magnetic materials.

* * * * *